US006419332B1

(12) United States Patent
Caldwell, Jr. et al.

(10) Patent No.: US 6,419,332 B1
(45) Date of Patent: Jul. 16, 2002

(54) FILE CABINET

(75) Inventors: Robert C. Caldwell, Jr.; Charles B. Carter; David Kersjes, all of Grand Rapids; Gardner Klaasen, II, Ada, all of MI (US)

(73) Assignee: Harbor Steel & Supply Corp., Muskegon, MI (US)

( * ) Notice: Subject to any disclaimer, the term of this patent is extended or adjusted under 35 U.S.C. 154(b) by 0 days.

(21) Appl. No.: 09/510,967

(22) Filed: Feb. 21, 2000

Related U.S. Application Data

(60) Provisional application No. 60/121,464, filed on Feb. 24, 1999.

(51) Int. Cl.[7] ..... A47B 81/00

(52) U.S. Cl. ..... 312/285; 312/125; 312/283

(58) Field of Search ..... 312/326, 270.2, 312/120, 123, 125, 135, 136, 197, 184, 283, 285, 305, 308; 211/1.52, 1.53, 1.54, 1.55, 163

(56) References Cited

U.S. PATENT DOCUMENTS

| | | | | |
|---|---|---|---|---|
| 241,123 A | | 5/1881 | Danner | |
| 264,747 A | * | 9/1882 | Potts | 312/197 |
| 405,003 A | | 6/1889 | Blackledge | 312/123 |
| 489,705 A | | 1/1893 | Blackledge | |
| 503,306 A | | 8/1893 | Bever | |
| 547,552 A | * | 10/1895 | Keegan | 312/285 X |
| 655,275 A | * | 8/1900 | Roth | 312/285 |
| 775,594 A | | 11/1904 | Bigelow et al. | |
| 823,901 A | | 6/1906 | Sturr | |
| 827,761 A | | 8/1906 | Stromgren | |
| 917,594 A | * | 4/1909 | Hake | 211/1.54 X |
| 1,054,311 A | | 2/1913 | Phillips | |
| 1,688,456 A | | 10/1928 | Dolph | 312/197 |
| 1,763,724 A | | 6/1930 | Rosenthal | |
| 2,161,323 A | | 6/1939 | Stephenson | |
| 2,663,608 A | | 12/1953 | Schauer | 312/326 |
| 3,642,338 A | | 2/1972 | Humphrey | 312/184 |
| 4,126,366 A | | 11/1978 | Handler et al. | 312/125 X |
| 4,317,606 A | | 3/1982 | Hastings | 312/231 |
| 4,431,238 A | | 2/1984 | Evans | 312/184 |
| 4,485,997 A | | 12/1984 | Potter | |
| 4,756,429 A | | 7/1988 | Lehman | |
| 4,783,130 A | | 11/1988 | Twellmann | 312/193 |
| 4,850,658 A | | 7/1989 | Sandor | 312/225 |
| 4,901,867 A | | 2/1990 | Petty, Jr. | 211/46 |
| 4,938,549 A | | 7/1990 | Potter | 312/305 |
| 5,056,876 A | | 10/1991 | Scheerhorn | 312/221 |
| 5,310,209 A | | 5/1994 | Holman | |
| 5,524,775 A | | 6/1996 | Kaine | 211/131 |
| 5,813,528 A | | 9/1998 | Blick et al. | 312/285 X |

FOREIGN PATENT DOCUMENTS

| | | | |
|---|---|---|---|
| DE | 253066 | * 10/1912 | 211/1.54 |
| DE | 1 094 508 | 12/1960 | |

OTHER PUBLICATIONS

P. 52 from the Levenger Catalog, Summer of 1999, Copyrighted 1999 by Levenger Company.

* cited by examiner

*Primary Examiner*—James O. Hansen
(74) *Attorney, Agent, or Firm*—Barry C. Kane; Miller, Johnson, Snell & Cummiskey, PLC

(57) ABSTRACT

A file cabinet providing access to files from substantially all sides, and having one or more rotatable tiers, each tier containing a plurality of file containers. Each tier includes a central support wherein at least one radial support arm is rotatably mounted thereto to rotate about the central support. Mounted to the terminus of each radial support arm is a file support, each configured to rotate about a vertical axis between a retracted position toward the interior of the tier, and an extended position. Each file support is adapted to receive a file container suspended thereon to provide detachable storage. Tiers may be added by attaching additional central supports in tandem.

29 Claims, 22 Drawing Sheets

FILE CABINET

CROSS-REFERENCE TO RELATED APPLICATION

This application relates to and claims priority from U.S. provisional patent application serial No. 60/121,464, filed Feb. 24, 1999, the specification of which is incorporated herein by reference.

BACKGROUND OF THE INVENTION

Field of the Invention

This invention relates to filing cabinets, file drawers, storage units and the like, and more particularly to a filing cabinet where more than one drawer may be opened at any one time without fear of the filing cabinet tipping over.

Lateral and vertical filing cabinets typically have drawers extending from one side of the cabinet frame. To prevent the cabinet from falling over, the filing cabinet is typically provided with a substantial counterweight, and an interlock mechanism which prevents more than one drawer from opening at a time. If not included, there is a danger that the cabinets will tip over. Examples of filing cabinets may be found in U.S. Pat. Nos. 3,969,008; U.S. Pat. No. 4,355,851; U.S. Pat. No. 4,429,930; U.S. Pat. No. 4,480,883; U.S. Pat. No. 4,711,505. Rotary filing cabinets have been devised wherein the drawers of the filing cabinet do not extend from the cabinet, but are mounted on a chain or linkage mechanism wherein the cabinets revolve in a vertical oval pattern within the cabinet. These prior systems require complicated safeguards or mechanisms to permit the user access to a single file drawer. Furthermore, these cabinets are almost always preassembled, requiring a substantial amount of shipping and stocking space.

A need exists for a filing cabinet which maximizes the storage space and permits access to more than one filing drawer without fear of the cabinet tipping over. There is also a need for a filing cabinet which can be shipped disassembled and employs standardized components which may be easily assembled without the need for special tool, thus maximizing shipping space and inventory space, yet is low cost.

SUMMARY OF THE INVENTION

The instant invention is directed toward a file cabinet accessible from all sides, and having one or more tiers, each containing a plurality of file containers. The combination of characteristics present in each of the designs provides maximum utilization of floor space, provides a safer cabinet design unlikely to tip over because of off center loads, and is accessible by simultaneous users. The design also permits assembly by the users as well as the manufacturer. The kit design requires considerably less packaging and shipping space than prior designs resulting in substantial cost savings.

According to one form of the invention, these principles are achieved by providing a base assembly supporting a central support assembly. The upper end of the central support assembly is configured to receive a top assembly for the cabinet. In its broadest form, at least one spider or disk-shaped support is provided along the central support assembly and rotatably about an axis defined by the central support. Attached to the outer margin of the spider or disk is at least one file support assembly having an upper end pivotally coupled to the end of the spider. The pivotal coupling permits the file support to rotate about an axis parallel to that of the central support member between a retracted position and an extended position. The file support is configured to detachably receive a file container thereon which swings with the file support between the two positions.

In another form of the invention, a kit is provided whereby the various components of the file cabinet are easily assembled to produce a file cabinet having the decreased number of tiers.

In all forms of the invention, the file container suspended on the file support is unique. The file container includes a basket rim formed by a plurality of interconnected and contoured walls. At least one of the walls to the basket rim includes a channel adapted to mate with a portion of the file support to suspend the container. Depending from the basket rim are a plurality of legs, each attached to the rim by a pivot connection permitting each leg to swing between an extended position and a folded position located toward and interior of the basket rim. Slidably disposed along the legs is a platform which forms the bottom of the container in the extended position. The platform and basket rim are configured to rest together when the legs are in the folded position. Various forms of the container are described including aesthetic side curtains and in one instance, a cloth drape is provided containing pockets for retaining accessories.

The advantages provided by the invention include a design which may be used in the home office as well as the business office. The design also requires less packaging because of its modular construction which translates into less shipping space producing a cost savings. The flexibility of the design also translates into cost savings as the basic building blocks are used to create one, two, three or four tier designs. Special tooling or parts are not required to produce the various designs. The instant invention provides 360 degrees of accessibility. The rotary tiers enhance access to the different file containers and allow placement of the cabinet against a wall or into a corner. Lastly the cabinet provides a wide range of appearance options. Different from the conventional metal or wood lateral file, the instant invention may include metal or cloth panels in a wide array of colors and patterns. Moreover, each file container may have a metal, plastic or cloth drape in a wide array of colors to provide an aesthetic appearance.

DETAILED DESCRIPTION OF PREFERRED EMBODIMENT

Figure 1:
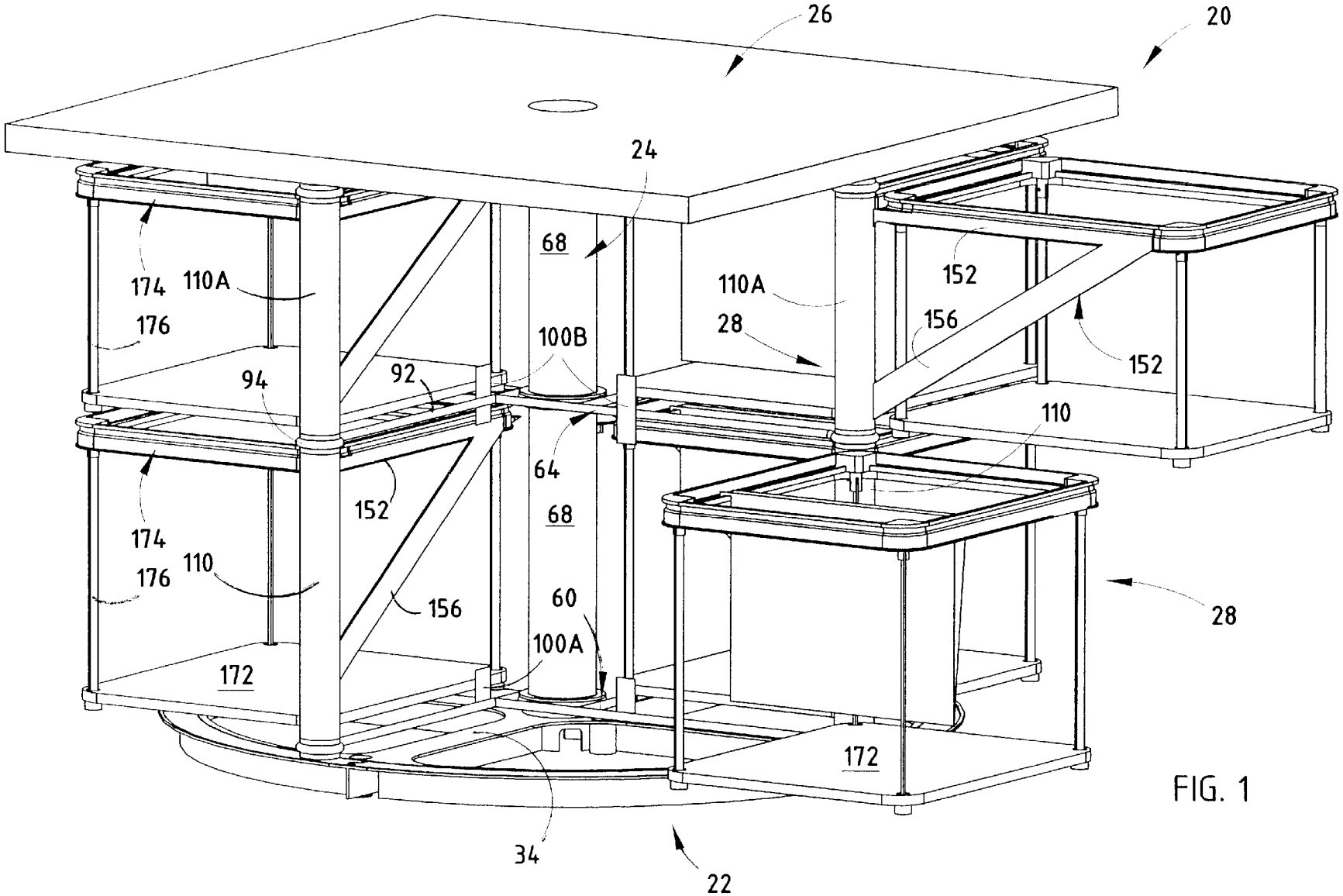
FIG. 1 is an oblique view of a filing cabinet assembly embodying the present invention.

For purposes of the following description, the terms "upper," "lower," "left," "rear," "front," "vertical," "horizontal" and derivatives of such terms shall relate to the invention as oriented in FIG. 1. However, it is to be understood that the invention may assume various alternative orientations; except where expressly specified to the contrary. It is also to be understood that the specific devices and processes illustrated in the attached drawings, and described in the following specification are simply exemplary embodiments of the inventive concepts defined in the appended claims. Specific dimensions and other physical characteristics relating to the embodiments disclosed herein are not to be considered as limiting, unless the claims expressly state otherwise.

Figure 2:
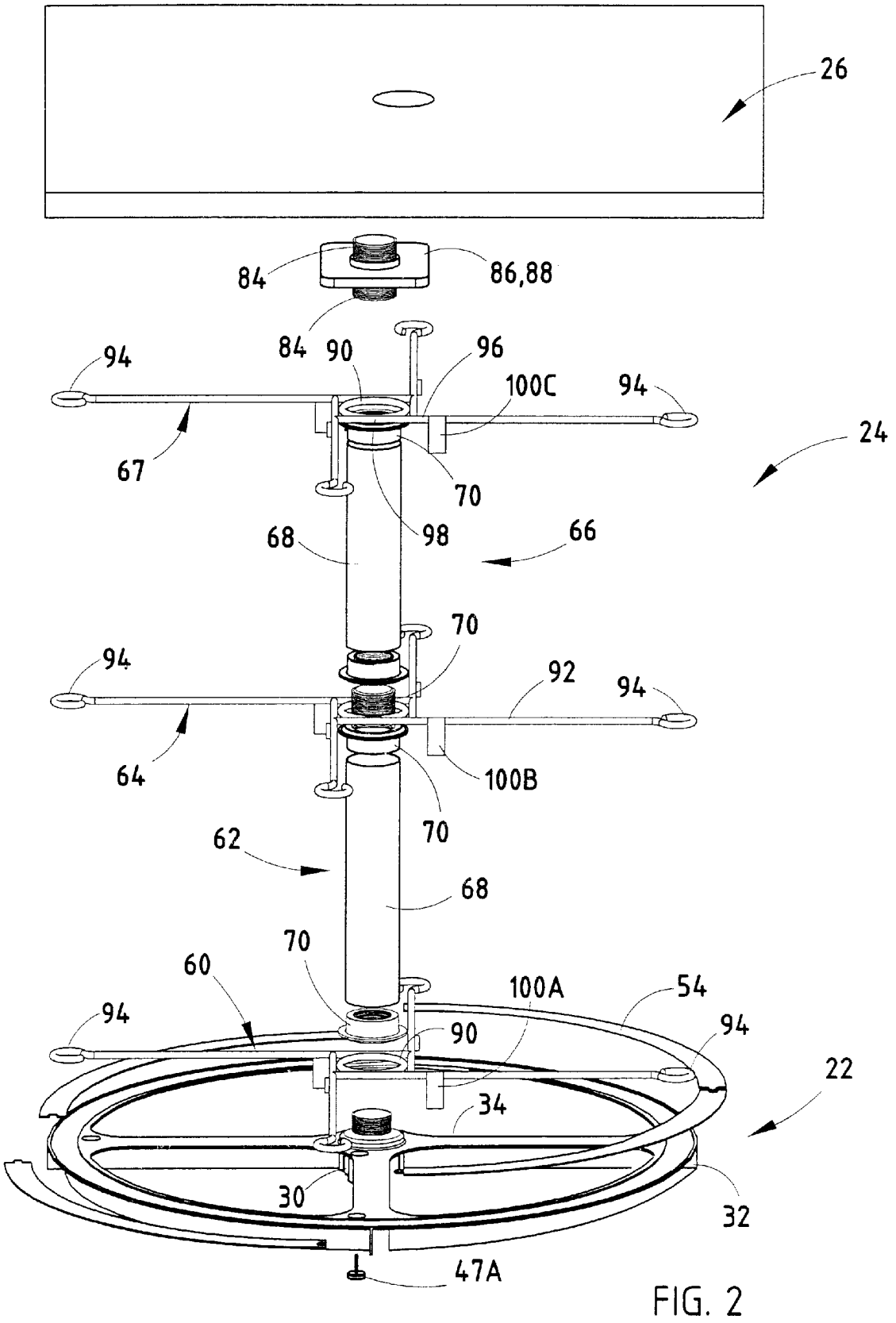
FIG. 2 is an exploded view of a portion of the filing cabinet embodying the invention shown in FIG. 1.
Figure 3:
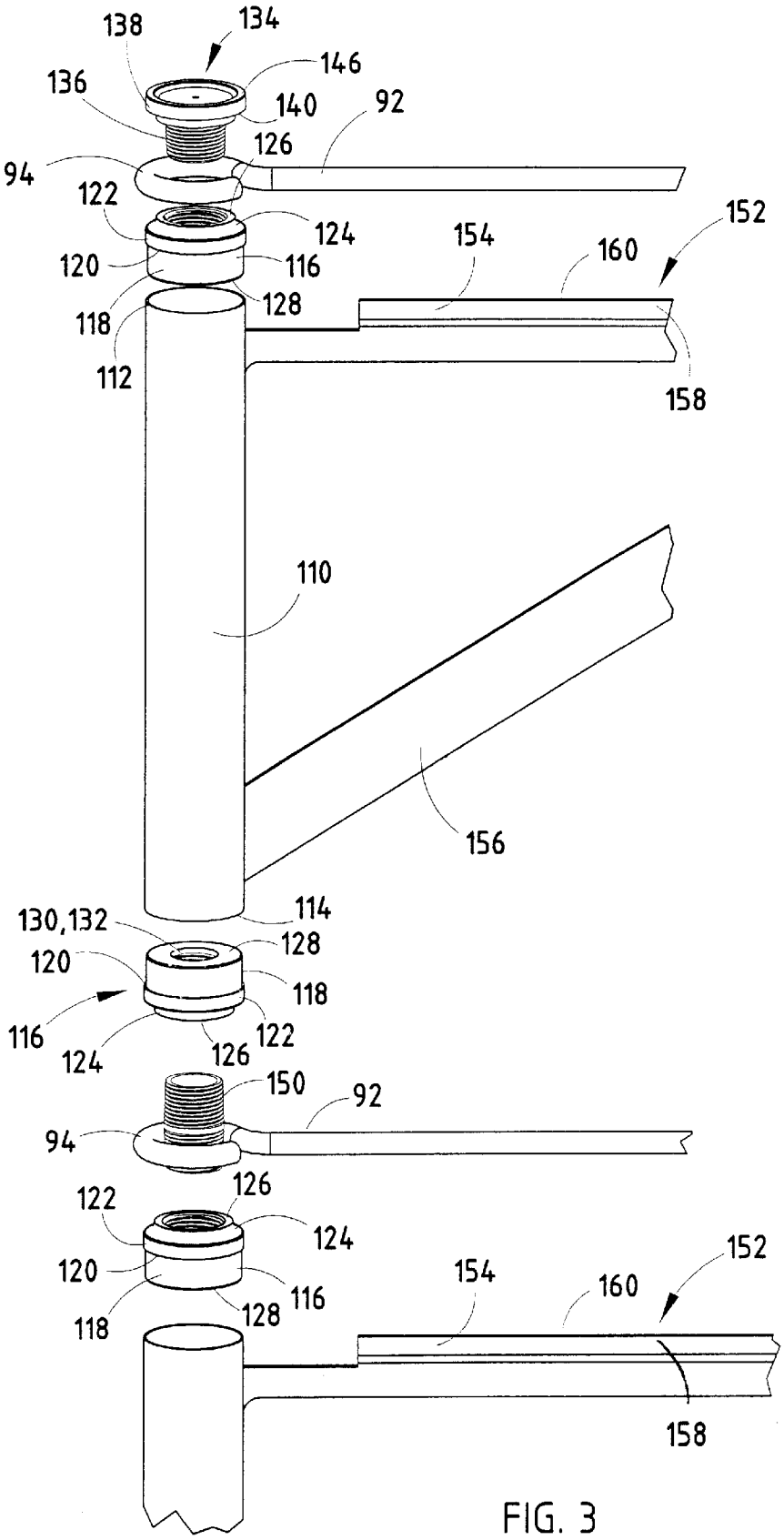
FIG. 3 is an exploded view of a drawer support assembly used in conjunction with the invention shown in FIG. 2.
Figure 4:
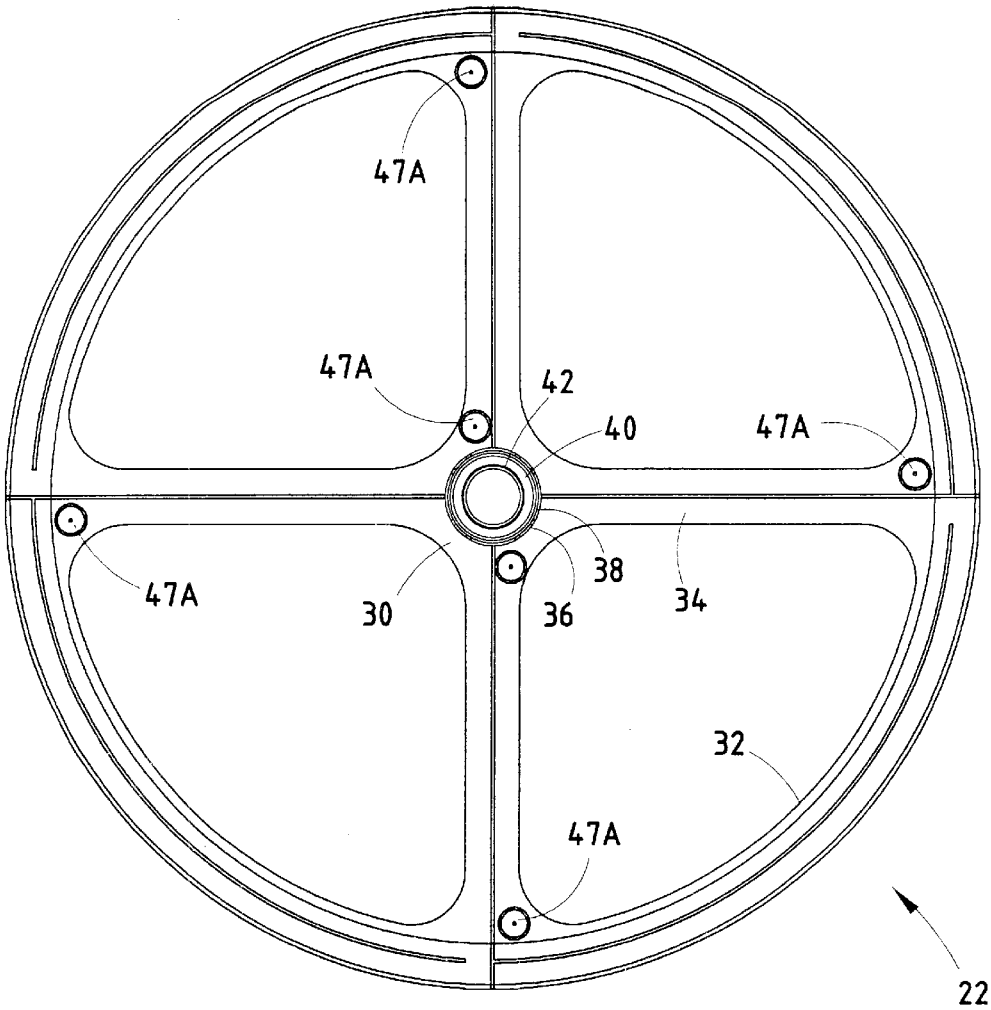
FIG. 4 is a plan view of the base assembly.
Figure 5:
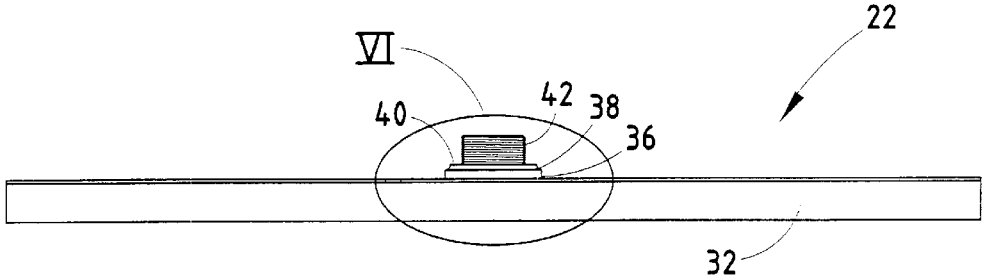
FIG. 5 is an elevation view of the base assembly.

Referring to FIGS. 1–3, cabinet 20 generally includes a base assembly 22, a central support assembly 24, a top assembly 26, and a plurality of file support assemblies generally referenced as 28. Referring to FIGS. 2 and 4–6, one form of the base assembly 22 includes a central hub 30 interconnected to an outer rim 32 by a plurality of spokes 34. In the embodiment shown, four evenly spaced spokes 34 are provided. Hub 30 (FIGS. 5 and 6) is generally higher in relief than the adjoining spokes 34 and in particular includes an upright cylindrical wall 36, the upper reaches of which contain a quarter-round or concave radiused annular groove 38. Annular groove 38, in turn, is connected by shoulder 40 to a right circular cylinder nipple 42. The exterior surface of the nipple 42 is preferably threaded for reasons which will apparent below.

The underside 44 of base assembly 22 may be hollow or contain passages. In a preferred embodiment, hub 30 is hollow and includes a plurality of openings 46 each located between spokes 34 to permit passage of cables, wires, and the like down through the central portion of the nipple 42, hub 30 and out between the spokes 34. Rim 32 may also be hollow or define a passage in communication with the hollows or passages beneath spokes 34 and central hub 30. In a preferred embodiment, outer rim 32 includes a recess 48 defined at an upper surface 50 which is generally circular in shape, and disposed proximate peripheral edge 52. Received in the recess 48 in at least one continuous piece, and preferably two or more sections is a metal glide or bearding surface 54 wherein an upper surface 56 extends slightly above surface 50 for reasons which will become apparent below.

Molded into and defined in the lower surface 44 of base assembly 22, and preferably disposed at intervals along spokes 34 and at points proximate hub 30 are leg supports 47. In a preferred embodiment, each leg support 47 includes a female member defined by a right circular cylinder outer wall and having a bottom wall of increased thickness. The cylindrical wall of the leg support is configured to receive a leg defined by a base attached to the end of a shaft. The shaft is preferably threaded and is received in a central hole formed in the base of the leg support to permit adjustment of the base relative to the lower surface of the base assembly. It is contemplated that the leg supports 47 may be formed using the same injection molding process at the time that the entire base assembly is formed. Alternatively, the cylindrical walls for the leg supports may be formed, and the leg and its supporting member may be inserted into the cylindrical member as a separate step. Substantially any supporting member by be provided so long as it permits height adjustment of the base at each location. The purpose of these legs is to provide a substantially horizontal upper surface 50 on which the filing cabinet is eventually placed. It is contemplated that base assembly 22 may be manufactured from polymeric material using injection molding, pour molding or similar forming processes, or may be cast or machined from steel, aluminum or even wood components. In the preferred embodiment, it is contemplated that base assembly 22 be injection molded from a polymeric material.

Figure 6:
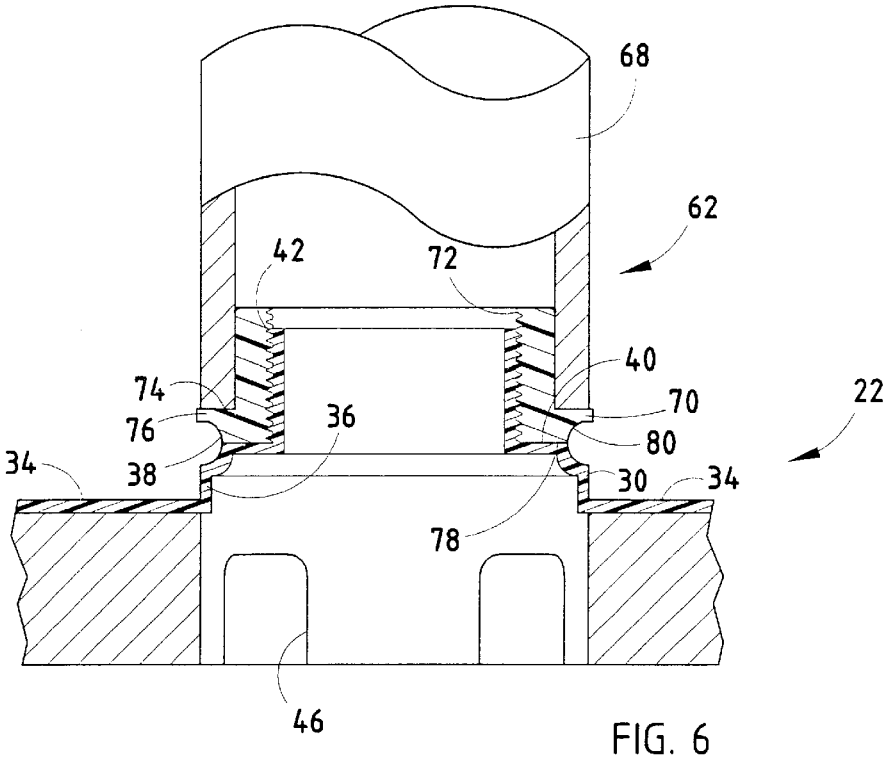
FIG. 6 is a fragmentary cross-sectional view of the base assembly hub and central support shown in FIG. 2.

Referring to FIGS. 2 and 6, threaded nipple 42 receives central support assembly 24. Central support assembly 24 includes a lower crossr member 60, a lower tube assembly 62, an intermediate cross assembly 64, an upper tube assembly 66, an upper cross member 67, which in turn is coupled to the top assembly 26. Each of the lower and upper tube assemblies includes a generally tubular, right circular cylindrical support 68 having a bushing 70 at opposite ends Each bushing 70, is preferably tubular and includes a concentric axial passage threaded on its interior to mate with the threads on the exterior of nipple 42. One end of each bushing 70 includes a reduced diameter cylinder portion 72 configured to be received in the open end of the support 68 which abuts tightly shoulder 74. At the perimeter of shoulder 74 is a wall 76 which transitions toward end 78 to a quarter-round annular groove 80 complimentary in shape and dimension to the quarter-round annular groove 38 described earlier for example formed in the hub 30 of the base assembly 32. The bushing 70 threaded down tightly against the shoulder 40 of the hub 30 along with the cooperating portions of the annular groove define an annular bearing recess. Disposed in this bearing recess is the lower cross member 60 briefly mentioned above.

Referring to FIG. 2, each of the cross members 60, 64 and 67 (also referred to as spiders) include a central circular bearing member 90. Bach circular bearing member 90 supports a plurality of arms 92. In a preferred embodiment, each arm has an outer end or a clevis 94, and is tangentially coupled to the circular bearing member 90 proximate a second and opposite end 96, Moreover, the opposite end 96 is preferably attached to the angularly adjacent arm 92. In this fashion, and in the case four arms 92, a polygon such as a square 98 is assembly configured to receive at lead one container detachably mounted thereon for retaining articles selected by a user.

The circular bearing member 90 of lower cross member 60 is captured in the annular bearing recess defined by bushing 70 and hub 30. Likewise, intermediate cross member 64 is captured between the respective bushings 70 at the ends of the supports 68 joined together by nipple 82. With respect to the upper cross member 67, the bushing 70 at the upper end of the upper tube assembly 66 is threaded to a nipple 84 projecting from a hub 86 extending from a insert 88 retained in the top assembly 26. In a preferred embodiment, the insert 88 has a rectangular flange at one end of the nipple 84 which is received in a rectangular recess formed in the table top assembly 26. Insert 88 in turn includes a hollow portion extending through the table top to provide a passage for cables and the like. It is contemplated that insert 88 is coupled by fasteners to at the lower side of table top 26.

Although the embodiment in FIG. 2 has been described with three cross members vertically disposed along the two tube assemblies 62 and 66, it is contemplated that a single tube assembly such as 62 may be used to support two cross members. Alternatively, the assembly may be repeated to include as many cross assemblies as desired depending upon the space requirements. Furthermore, each cross assembly shown in FIG. 2 is, without more structure, able to rotate independently about the bearings provided by bushings 70. In a preferred embodiment bushings 70 are preferably injection molded from a self-lubricating polymeric material to reduce friction between the circular bearing members 90 and the bushings. It is further contemplated that roller bearing or other bearing structures may be used to support the cross member and further reduce the friction associated with the rotation of the cross members about the fixed central supports.

Figure 7:
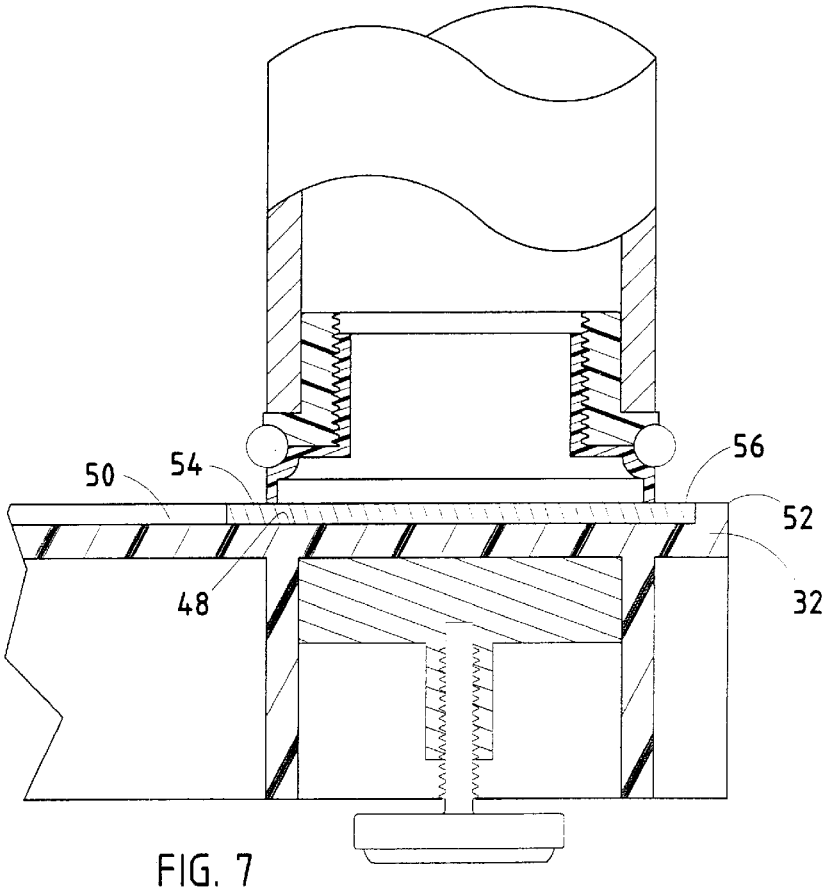
FIG. 7 is a fragmentary cross-sectional view of a portion of the base assembly and file support assembly.
Figure 8:
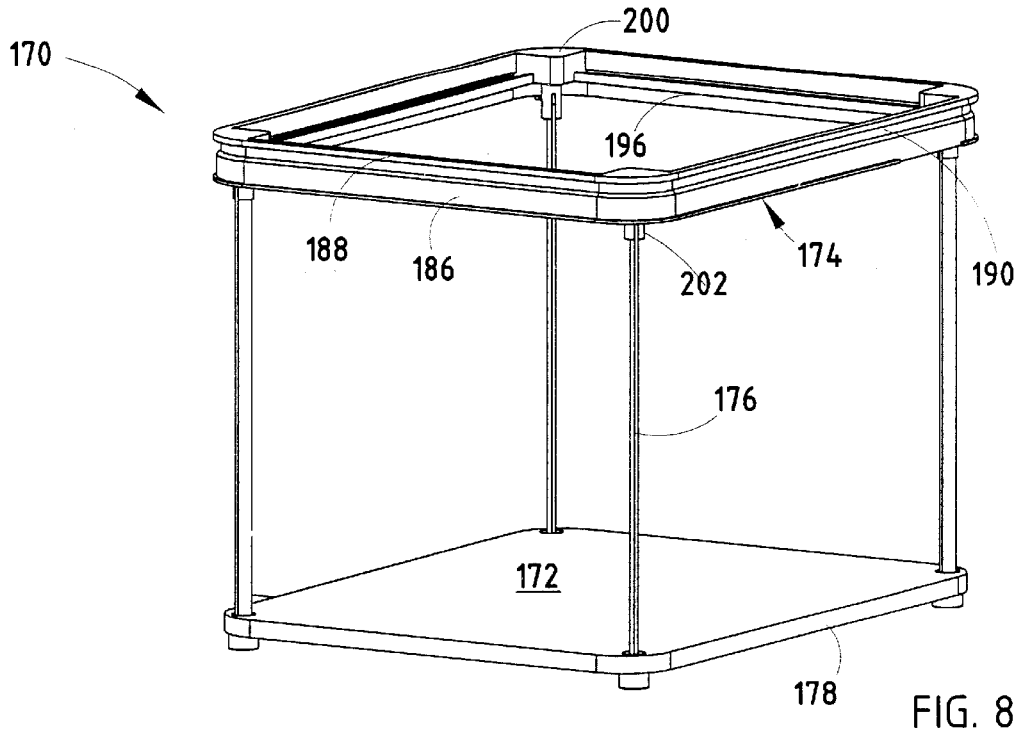
FIG. 8 is an oblique view of a hanging basket used in association with the invention.
Figure 9:
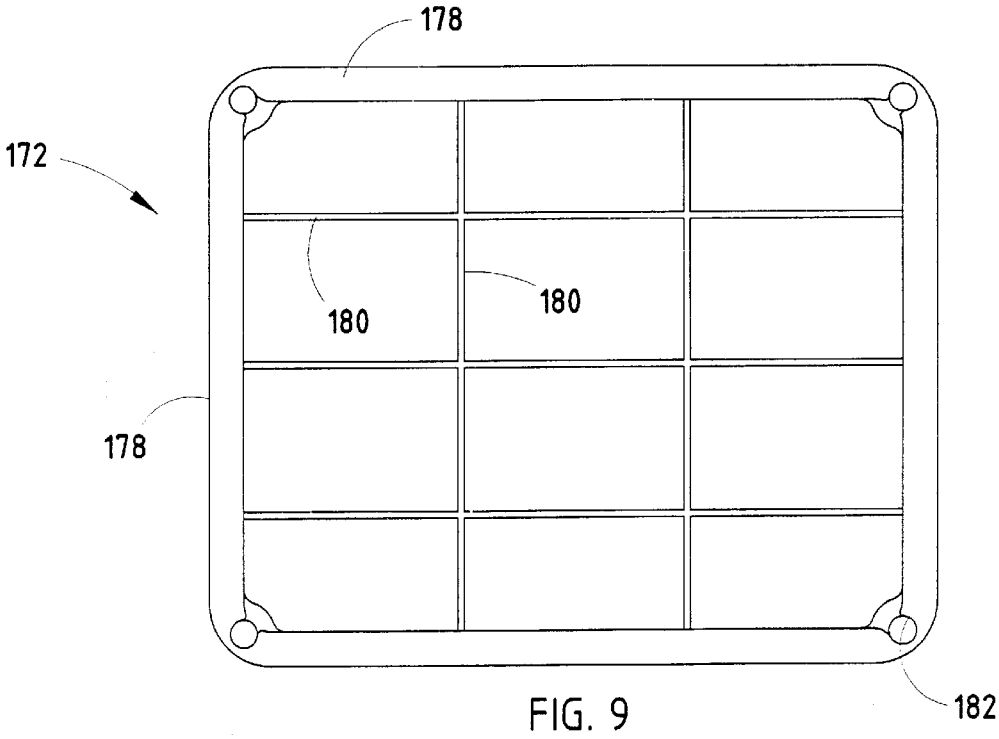
FIG. 9 is a plan view of the basket base.
Figure 10:
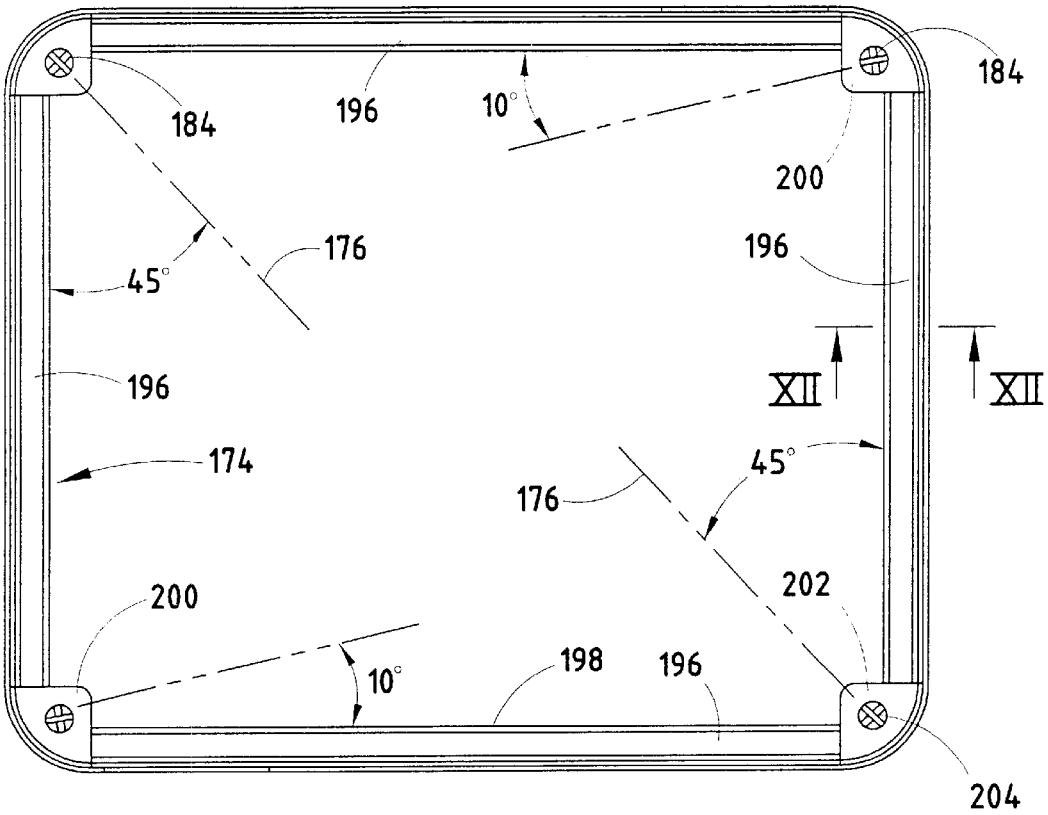
FIG. 10 is a plan view of the basket rim.
Figure 11:
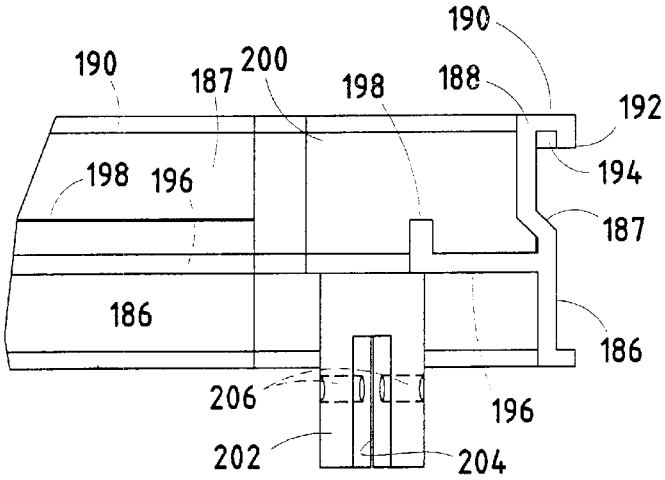
FIG. 11 is a fragmentary cross-sectional view of the basket rim taken along the line XII—XII shown in FIG. 10.

Referring to FIGS. 1, 3 and 7, it is preferred that the termini or clevis ends 94 of the lower, intermediate, and upper cross members be vertically aligned and interconnected by file support assemblies 28. Support assemblies 28 support the outer ends 94 of the cross members 60,64, and 67 and provide a structure from which drawers, trays or boxes are suspended. In addition, file support assemblies 28 provide a unified support for rotating cross members 60, 64 and 67 about the central support assembly 24. File support assemblies 28 includes at least one file support tube 110 having a concentric longitudinal passage extending entirely therethrough between ends 112 and 114. Received in each end 112, 114 of the file support tube 110 is a bushing 116. Each bushing 116 includes a cylindrical sleeve portion 118 having a outside diameter substantially equal to the inside diameter of the end 112, 114 and is prevented from sliding entirely into the support tube 110 by a shoulder 120 which abuts against the end 112 or 114. The peripheral edge of the shoulder 120 is defined by a wall 122 which transitions downwardly into a quarter-round annular groove 124 before terminating at the end 126. Extending between end 126 and the opposite 128 is a concentric longitudinal passage 130 having a threaded interior wall 132. Each file support tube 110 is disposed vertically between the clevis ends 94 of the adjacent cross members. The quarter-round concentric annular groove 124 in each bushing 116 is dimensioned to receive an nest the clevis end or termini 94 of each arm 92. In the case of the lower cross member 60, the bushing 116 at the lower end 114 of the tube 110 is retained by a bearing support member 134 which includes an outer diameter (O.D.) nipple 136 threaded configured to pass through the clevis end 94 and into the threaded interior wall 132 of bushing 116. Extending from the lower portion of the nipple 136 is a shoulder 138 of a dimension equal to end 126 extending between the passage 130 and the edge of the quarter-round annular groove 124 and configured to abut against end 126. Between shoulder 138 and the outer wall 142 of the bushing is a quarter-round annular groove 140 complimentary to that in the bushing 116 and configured to engage the opposite surface of the clevis end 94. The two grooves 124 and 140 then provide a bearing surface for the clevis end 94. The end of the bearing support member 134 may include a shallow recess 146 which defines a circular or annular bearing surface to engage the bottom side of the top 26 to provide support. The bearing surface also permits rotation of support tube 110 relative to the work surface/top 26. In a preferred embodiment, the bearing support member 134 is injection molded or fabricated from a self-lubricating polymeric material such as DELRIN® or similar material. A connection similar to that just described is used to interconnect the upper file support tube 110A to the clevis ends 94 at the termini of the arms 92 on the upper cross member 67. Interconnecting the bushing 116 at the upper end of the lower file support tube 110 to the bushing at the lower end of the upper support tube 110A, is a O.D. threaded nipple 150. It should be noted that the distance between the upper cross member 67, the intermediate cross member 64, and the lower cross member 60 may be varied, controlled principally by the length of the lower and upper tube assemblies, as well as the lower and upper file support tubes. For example, in the embodiment shown in FIG. 1, the lower tube assembly 62 as well as the lower file support tubes 110 may each have a height of approximately 12 inches while the height of the upper tube assembly 66 and the upper file support tubes 110A may have a height of approximately 10 inches. In this configuration, drawers or baskets of different heights may be hung at different levels to suit particular needs.

In FIGS. 1 and 3, each of the file support tubes 110 and 110A include a hanger arm assembly 152 defined by an upper arm 154 extending radially outward from a point proximate end 112 for a predetermined distance. A brace arm 156 is provided interconnecting a point proximate lower end 114 the outermost end of the upper arm 154. A portion 158 of the upper edge 160 of the upper arm 154 is offset from the plane of the arm 154 to provide a lip for engaging a channel or flange of a basket suspended thereon. The basket is maintained in the upright position by lower bracket or brace 156. Although a wide range of baskets may be adapted for suspension on the hanger arm 152, a preferred basket design is contemplated and described in greater detail below.

A contemplated container for use in association with the cabinet embodying this invention is shown in FIGS. 8–11, and is particularly suited for suspending hanging files such as available under the Pendaflex brand name, In one form, a collapsible basket 170 includes a bottom panel 172 suspended from a file hanger or rim 174 by a plurality of metal straps 176. The bottom panel 172 preferably has a generally rectangular perimeter 178 wherein opposite ends or sides of the panel are interconnected by a plurality of orthangonally interconnected ribs 180. At the corners of the perimeter 178, holes 182 are provided extending through the web and are adapted to receive the ends of the metal straps 176 therethrough. Cross pins 184 at the ends of the straps 176 provide a suspension point. As in the bottom panel, the upper rim 174 (FIGS. 10 and 11) includes an outer perimeter wall 186 which includes an upper portion offset or staggered inwardly from that of the lower portion. The upper end 188 of the wall 186 further includes an outwardly extending flange 190 terminating in a downward extending lip 192 to define a channel 194. Extending inwardly midway up from wall 186 is a horizontally disposed flange 196 terminating in an upwardly extending lip 198. This structure extends substantially around the entire inner perimeter of the wall 186 to define a channel for receiving the ends of hanging files such as the Pendaflex files mentioned above. In the corner of each rim 174 and interconnecting the adjacent ends of the inner flanges 196 are platforms 200 which extend inwardly midway up along the wall 186. As shown generally in FIG. 10, each platform 200 is generally a right triangle in plan form wherein the hypotenuse conforms to the curvature of the perimeter wall 186. Depending downwardly from a central location of the platform 200 is a generally cylindrical member 202. The cylindrical member 202 is split longitudinally to provide a generally rectangular longitudinal passage or slot 204 configured to receive the metal hanging straps 186 therein. Proximate the upper end of the cylindrical member 202 and transverse to the rectangular longitudinal passage are slots 206 on opposite sides of the passage 204, each configured to receive on end of a pin 184 extending transversely through the metal hanging strap 176. In this fashion, the hanging strap 176 is permitted to swing through an arc of 90° from the vertical upwardly inward toward the interior portion of the rim so that each strap can be folded generally parallel to the plane containing the rim of the basket 170. In a preferred embodiment, the angular orientation of each metal strap with respect to a longitudinal side of the rim are the same in opposite comers. For example, in the embodiment shown in FIG. 10, the straps in the upper left and lower right comers are oriented at 45 where the straps on the lower left and upper right comers have a 10° deflection. This permits the hanging members to fold in the same plane without overlapping each other. It should be noted at this point that the bottom panel 172 is configured to nest within the lower portion of the rim 174 below the inner flange 196. Additionally, the circular holes 182 formed at the comers of the bottom panel 172 have a diameter just slightly larger than the diameter of the cylindrical members 202 depending from the platforms 200 of the rim 174. It is contemplated that the bottom panel 172 may slide vertically upward along each of the metal hanging straps 176 and nest in the bottom of the rim 174 such that the cylindrical members 202 are received in the holes 182. The bottom panel is then above the pivot point of the metal hanging pin 184 in the cylindrical members 202 so that the metal hanging members 176 may be folded inwardly against the bottom panel.

In operation, (FIG. 8) the baskets 170 are expanded by extending the metal hanging straps 176 to a vertical position and pushing the bottom platform 172 downward to its fullest extent. The baskets are then hung on the upper arm 152 by placing the portion 158 of the upper arms 154 within the channel 194 at the upper outside edge of the baskets 170. While support assemblies 28 may be rotated inward to place the baskets under the top assembly 26, the inward rotation of the file support assembly 28 is halted by a flange such as flange 100 extending upward from lower cross member 60, flange 100A extending from intermediate cross member 64 and flange 100B extending downwardly from the upper cross member 67. The entire file assembly and cross members may be rotated by pushing on the file support assemblies 28 around the central support.

In an alternate embodiment, it is contemplated that the central support structure resting on the base assembly 22 may be altered by suspending the central support assembly 24 from the top assembly 26. The bending moment produced by the weight of the files on the ends of the cross members may be supported by a circular track or channel suspended from the lower surface of the top assembly 26. The filing cabinet would then be supported at the edges of the top assembly by an adjacent structure such as adjoining tops, credenzas, desks and the like.

Figure 15:
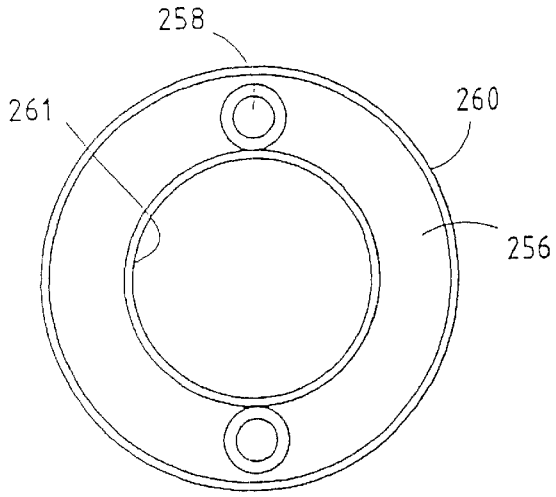
FIG. 15 is a bottom view of a nipple extending from the base assembly.
Figure 16:
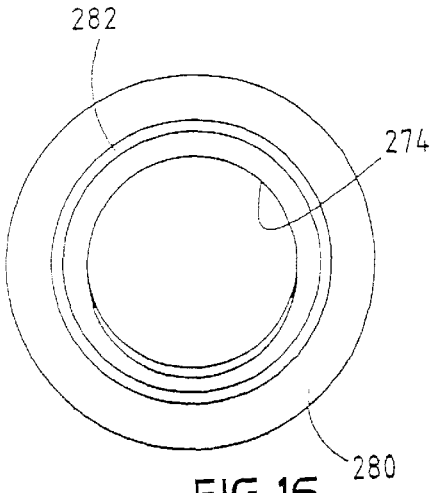
FIG. 16 is a plan view of a nipple extending from the base assembly.

Another form of the instant invention is shown in FIGS. 12–34. In this different form, the invention is based on the same general principal of providing a central member which radially supports a plurality of file support assemblies, each capable of suspending a file basket therefrom, and swing about a vertical axis to move the file baskets between a stored position close to the central member and a second position extending out away from the center post. Referring to the drawing figures, cabinet assembly 220 includes a base assembly 222 supporting a central support assembly 224, a top assembly 226, and a plurality of radially disposed file support assemblies, generally referenced as 228. Base assembly 222 (FIGS. 12 and 15) preferably is formed from metal rod to provide an outer rim or track 232 interconnected to a concentric inner hub 230 by a plurality of radially arranged spokes 234 such that hub 230 and rim 232 are supported above a reference plane (RP) such as defined by a floor. In the preferred form of the invention, rim 232 is made from a single length of rod, with the opposite ends welded together at a junction with one of the supporting spokes. The spokes and hub are also coupled together by welds. The hub 230 is preferably formed from a metal plate 235 having a plurality of radially spaced holes 236 disposed about a central opening 238, all extending through the thickness of the plate 235. Each hole 236 is configured to receive a respective end of one of the spokes 234, which is welded into place. Adjacent central opening 238, and disposed diametrically opposite each other are two mounting holes 240*a*, 240*b* to attach the central support assembly 224 described below.

Mounted to hub plate 235 and extending substantially perpendicular therefrom is the central support assembly 224. The central support assembly 224 is configured to support at least one, and preferably several tiers of files. However, the assembly may be reconfigured to support a single tier and may be supplemented by repeating sequences to support multiple tiers. It is contemplated that up to four or more tiers may be supported by the central support assembly 224. It is also preferred that central support assembly 224 be tubular in construction to provide a chase for passing cabling or wires down through the hub plate. Referring to FIGS. 12–19, central support assembly 224 includes a tubular threaded nipple 242 at a lower end configured to mate with the hub plate 235, and a lower cross member 244, at least one tube assembly 246, an upper cross member 248, and a top assembly 250. In the two tier embodiment shown in FIG. 12, an intermediate cross member 252 is shown, disposed between the lower tube assembly 246 and a second or upper tube assembly 254. Threaded nipple 242 is preferably made from plastic although aluminum or steel may also be used. A lower end 256 includes a central passage 261, two diametrically opposed pins 258 on opposite sides of passage 261 and configured to be received by mounting holes 240A and 240B in the hub plate 235. The lower end of nipple 242 is defined by a flange portion 260 which transitions over a chambered shoulder 262 to a threaded body 264 until terminating at upper end 266.

Figure 17:
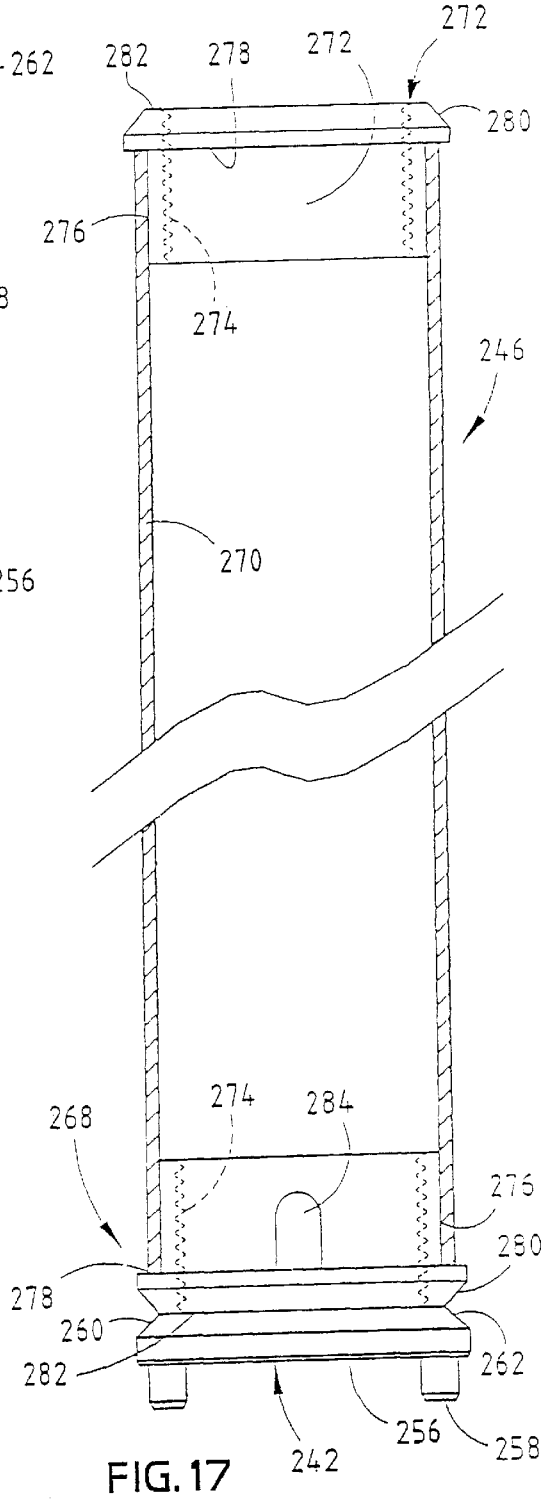
FIG. 17 is a fragmentary elevation cross section of the central support assembly taken along line XVI—XVI shown in FIG. 12.

Received over threaded end 266 of nipple 242 is the lower tube assembly 246 (FIG. 17). As briefly mentioned above, in the event a single tier configuration is desired, only a single tube assembly 246 may be used. However, if a multi-tiered structure is preferred, multiple tube assemblies may be stacked to increase the height and support the structure of the cabinet. Both embodiments will be described herein. In the instance of a single tier structure, tube assembly 246 includes a bushing 268 at a lower end, a tubular body 270, and a second bushing 272 at an opposite end. Bushings 268 and 272 are substantially identical in appearance and include a tubular central passage 274, an outer wall 276 dimensioned to be slidably received inside on end of tubular body 270, and a shoulder 278 configured to butt against the end of tubular body 270. From shoulder 278, the exterior is defined by a chambered surface 280 which terminates in end 282. In the preferred embodiment, central passage 274 is threaded to mate with the threads 264 on the nipple 242 so that the chambered surfaces may lie adjacent each other as in FIG. 17. To prevent tubular body 270 from spinning freely around outer wall 276 of each bushing 268, 272, a key 284 is defined on the exterior of wall 276 adapted to fit in a slot (not shown) formed in the end wall of tubular body 270.

Figure 18:
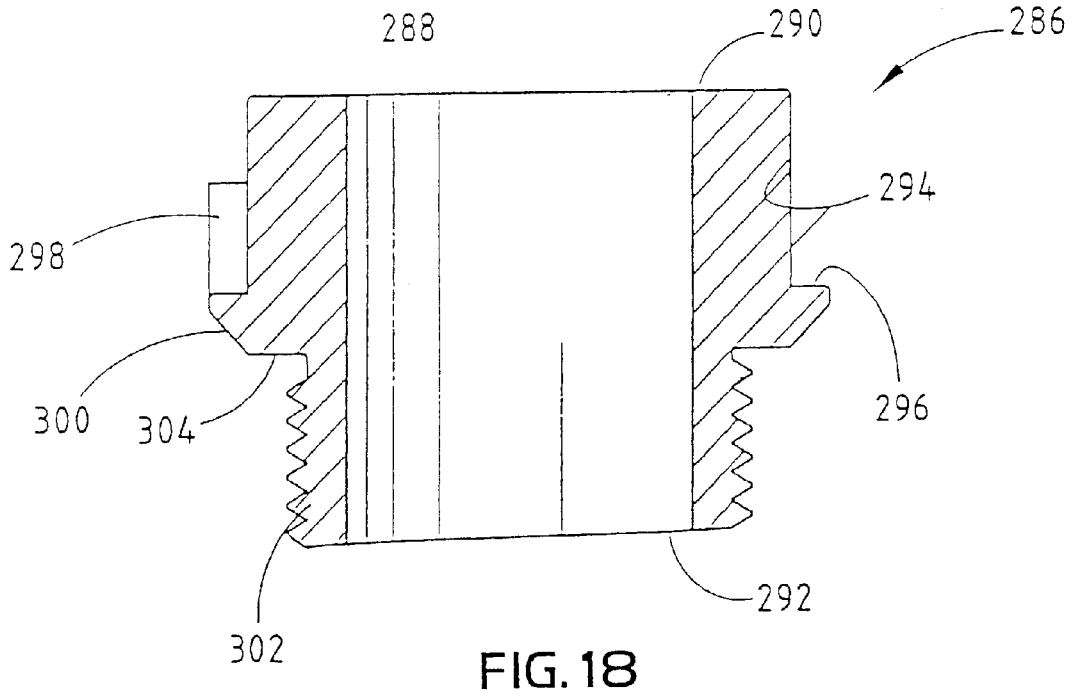
FIG. 18 is a fragmentary elevation cross section of a coupling between two tubular bodies of the central support assembly.
Figure 19:
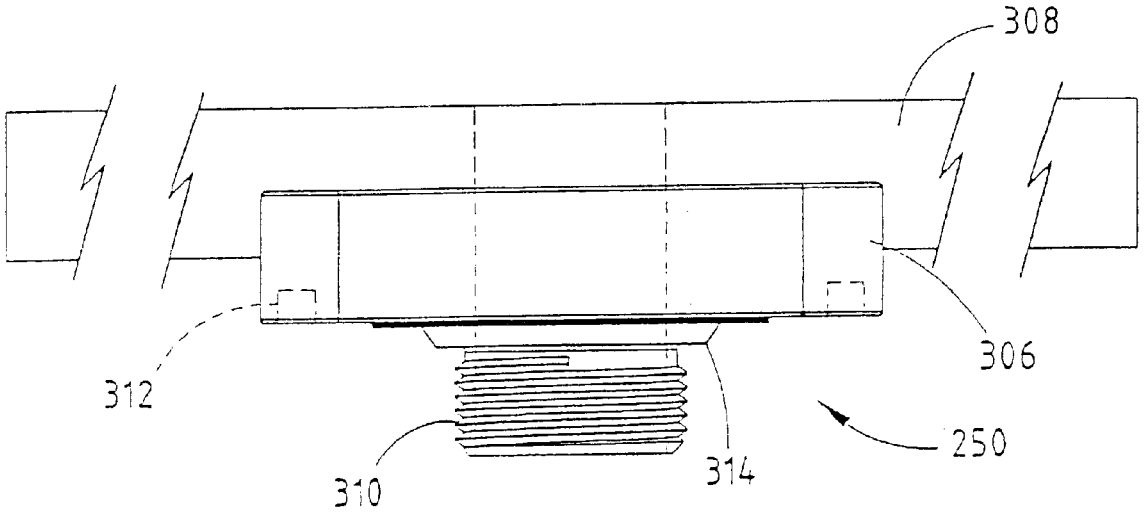
FIG. 19 is a fragmentary elevation view of the top assembly.

For multiple tier designs, bushing 272 at the upper end of tube 270 is connected by a male threaded bushing such as 286 shown in FIG. 18, where end 290 is received in the lower end of the overlying tube. To interconnect tube assemblies such as 246 and 254 shown in FIG. 12, the upper bushing 272 of the lower tube assembly 246, or alternatively, the lower bushing 268 of the upper tube assembly 254, may be replaced with a nipple connector such as 286. Connector 286 includes a tubular passage 288 extending from end 290 to end 292. The dimension of the outer wall 294 is such to just slide within the end of tubular body 270 until the shoulder 296 butts against the end of the tube. A key 298 is defined in wall 294 to be received in slot (not shown) to fix the relative rotational positions of the bushing and the tube. From shoulder 296 to end 292, a cot 300 is provided before changing to althreaded male member 302. The threads of the mating member 302 mate with the female threads of passage 274 to place the end 282 of the bushing adjacent the end 304 of the chamber. In either of the single or multiple tier designs, the upper end of the last tube assembly preferably contains a b n substantially similar to bushing 268 and 272. The top assembly 250 includes a range 306 connected to atop or work surface 308 of the cabinet using conventional listeners. A threaded nipple 310 extends from one side 312 to mate with the upper bushing such as 268 or 272 (FIG. 19). A chamber 314 similar to those described earlier is defined extending from side 312 to transition to nipple 310 for reasons described below.

Figure 20:
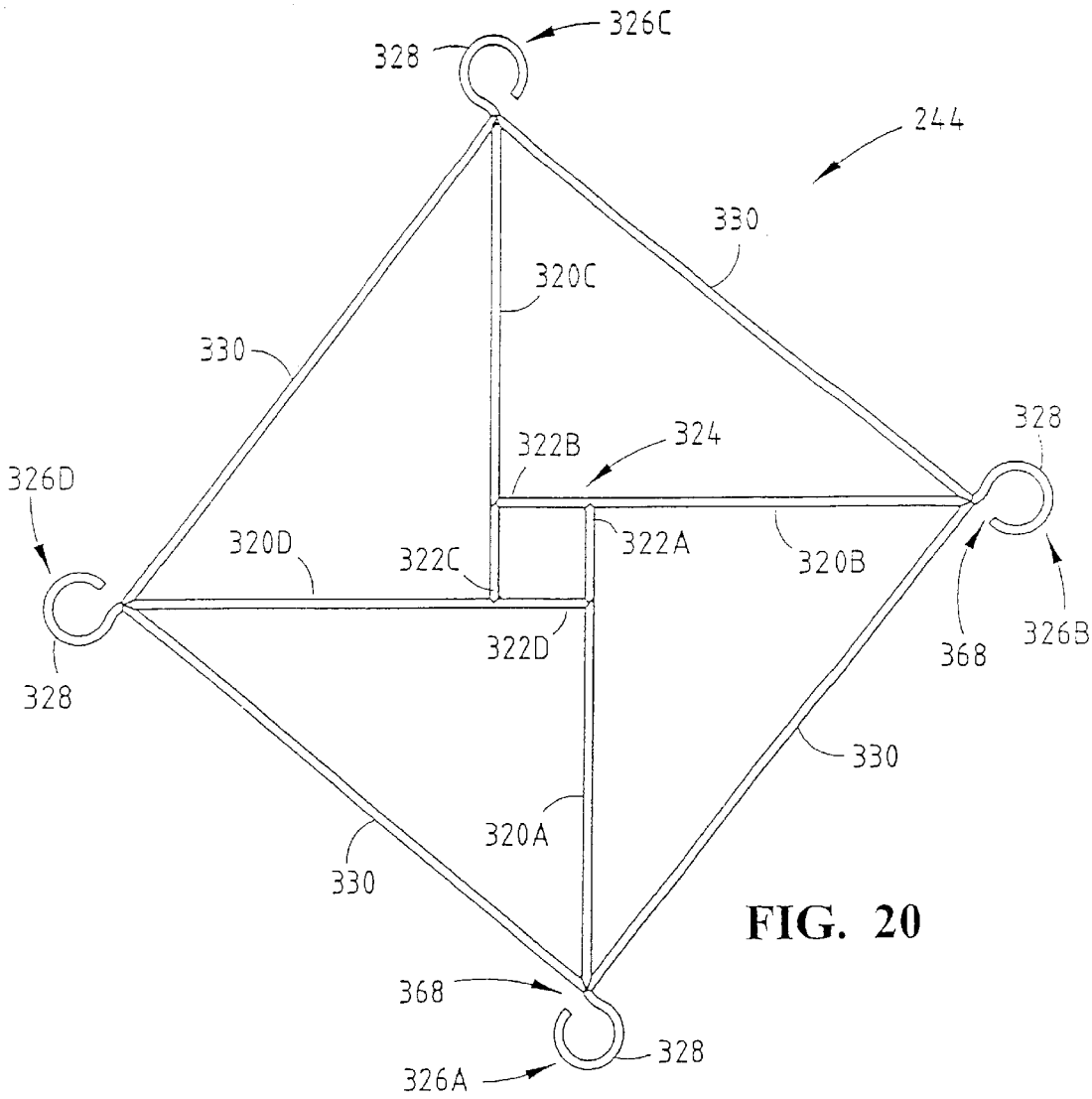
FIG. 20 is a plan view of a cross member.

As briefly mentioned above, and depending upon the number of tiers cabinet 220 is configured to provide, cross members are mounted to the central support assembly. In the case of a single tier file cabinet, at least one upper cross member 248, and preferably a lower and upper cross members 244 and 248 are used. If multiple tiers are configured, it e cross members such as 252 are also used. No matter what configuration, it is contemplated that all cross members are substantially identical in configuration such as shown in FIG. 20. Each cross member 244 includes a plurality of radially disposed arms such as 320A, 320B, 320C, and 320D, each having one end 332A, 332B, 332C, and 332D attached to the angularly adjacent arm to define a polygonal-shaped core or ring 324. The opposite ends 326A, 326B, 326C, and 326D terminate in a clevis 328. Angular brace members 330 interconnect angularly adjacent arms 320 at points proximate the base of each clevis 328. In one form of the invention, each cross member or spreader such as 244, 248 or 252, is made from three-eighths inch cold rolled bar steel. The lower, upper and any intermediate spreaders 246, 248 or 252 are mounted along the central support assembly 224 such that the polygonal ring 324 is captured between the chambers of the bushings and the respective opposing nipple or coupler (for example 262 and 280; 280 and 300; and 280 and 314). The polygonal ring 324 is dimensioned such that a central portion of each arm is in contact with the opposing chambered surfaces and permit each spreader to spin, pivot or rotate around the vertical axis defined by the central support assembly 224. Note that only the portion of each arm 320 tangential to the chambered face makes contact for the bearing point. It is believed that friction is substantially reduced in this manner to provide easy rotation of each spreader.

In one form of the invention, the termini or clevis ends 328 of the different spreaders (244, 248 and optionally 252) are vertically aligned and interconnected by the file support assemblies 228. As in the previous embodiment, the file support assemblies 228 support the outer ends 328 of the spreader bars and provide a structure from which drawers, boxes, crates or trays are suspended. In addition, the file support assemblies interconnecting the different spreader bars provide a means for uniformly rotating the one or more tiers. In the embodiment shown in FIG. 12, all tiers are interconnected so rotation of one tier causes rotation of the others. It is contemplated that additional spreader bars or cross members may be incorporated so that each tier rotates independently of the others.

Figure 24:
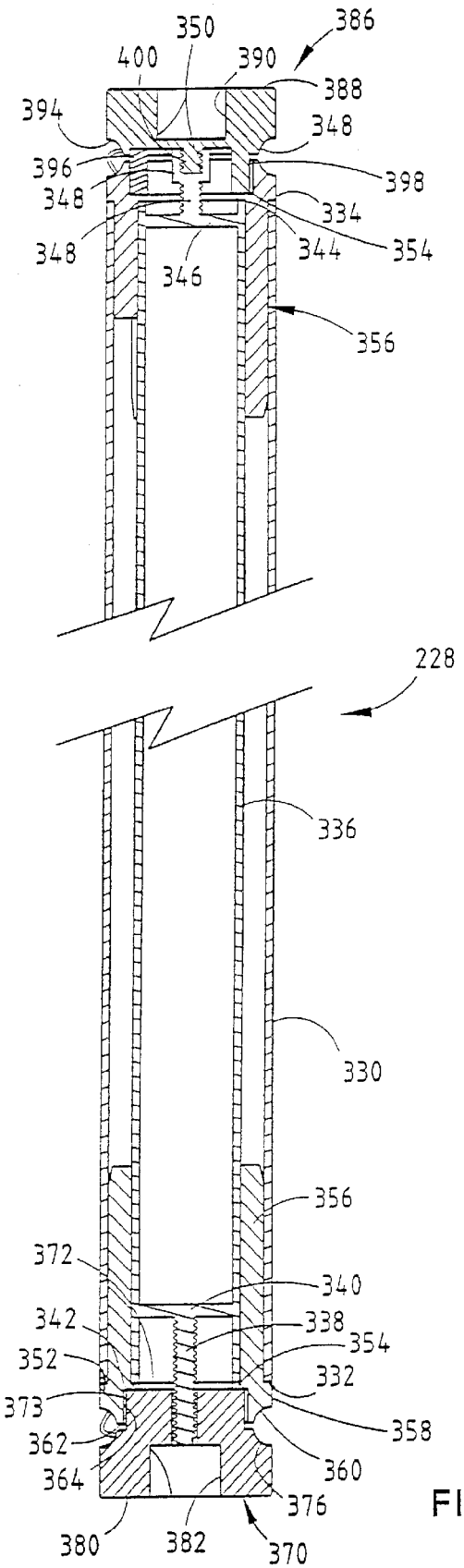
FIG. 24 is an fragmentary elevation cross section view of the file support assembly taken along line XXIV—XXIV shown in FIG. 22.
Figure 25:
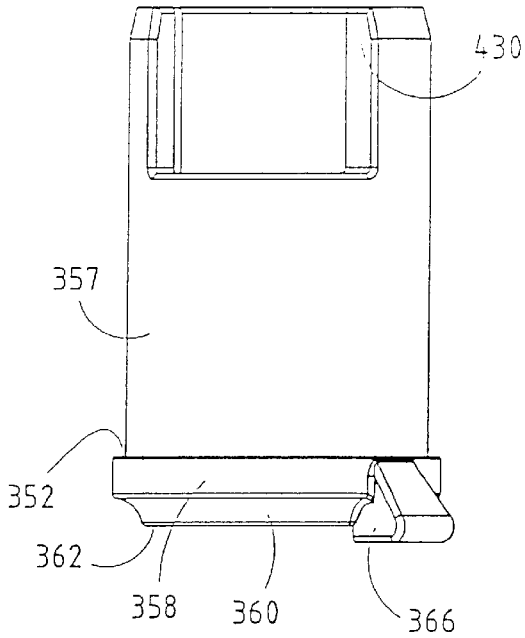
FIG. 25 is an elevation view of a file tube bushing used in a file support assembly.
Figure 27:
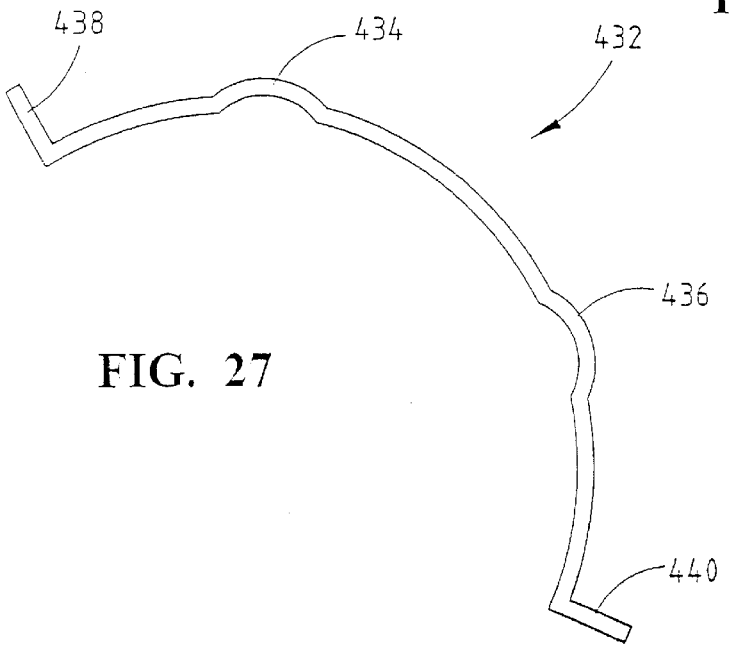
FIG. 27 is a plan view of the spring shown in FIGS. 26.
Figure 28:
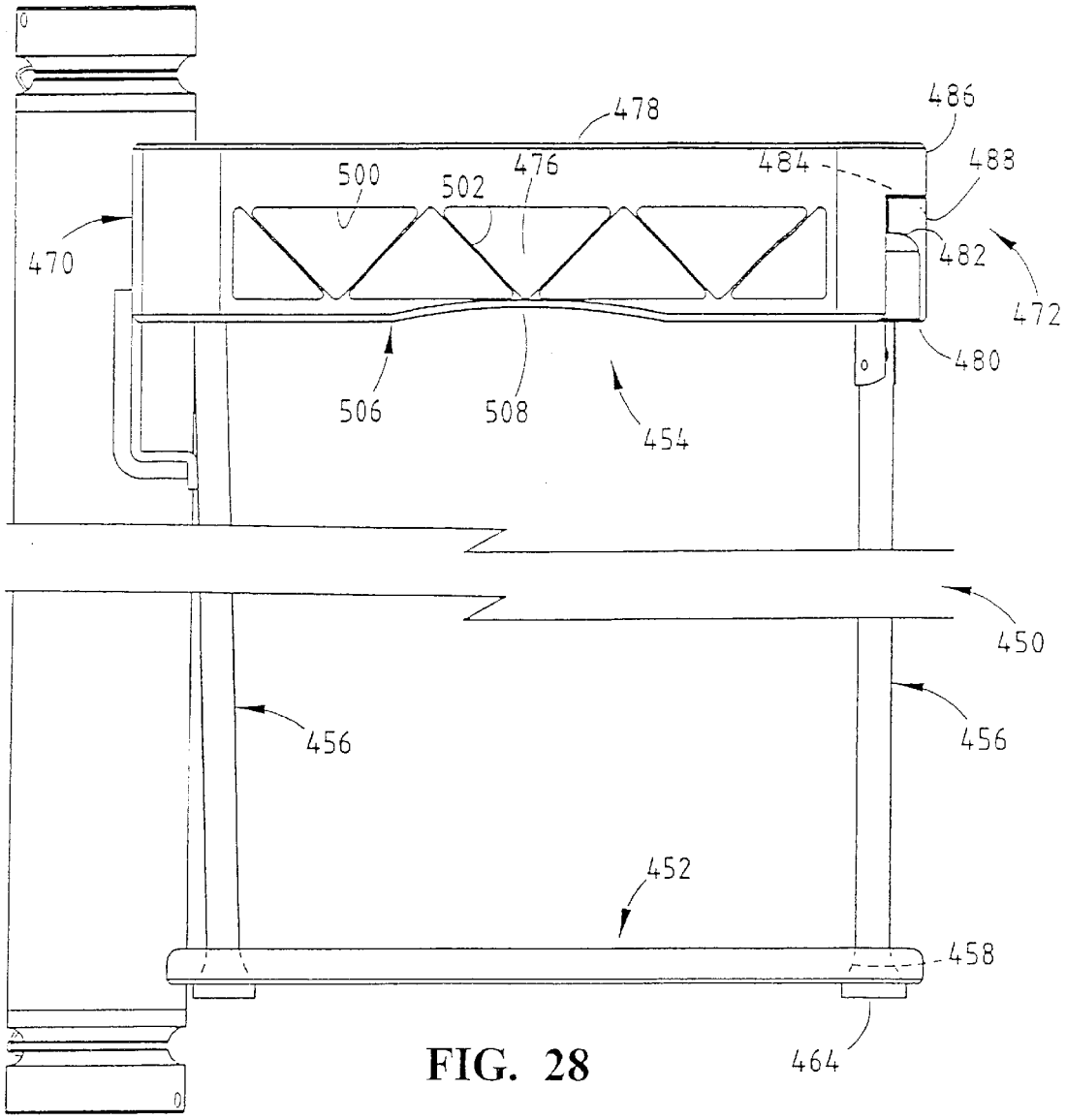
FIG. 28 is a side elevation view of one embodiment of a basket mounted on the file support assembly shown in FIG. 23.
Figure 29:
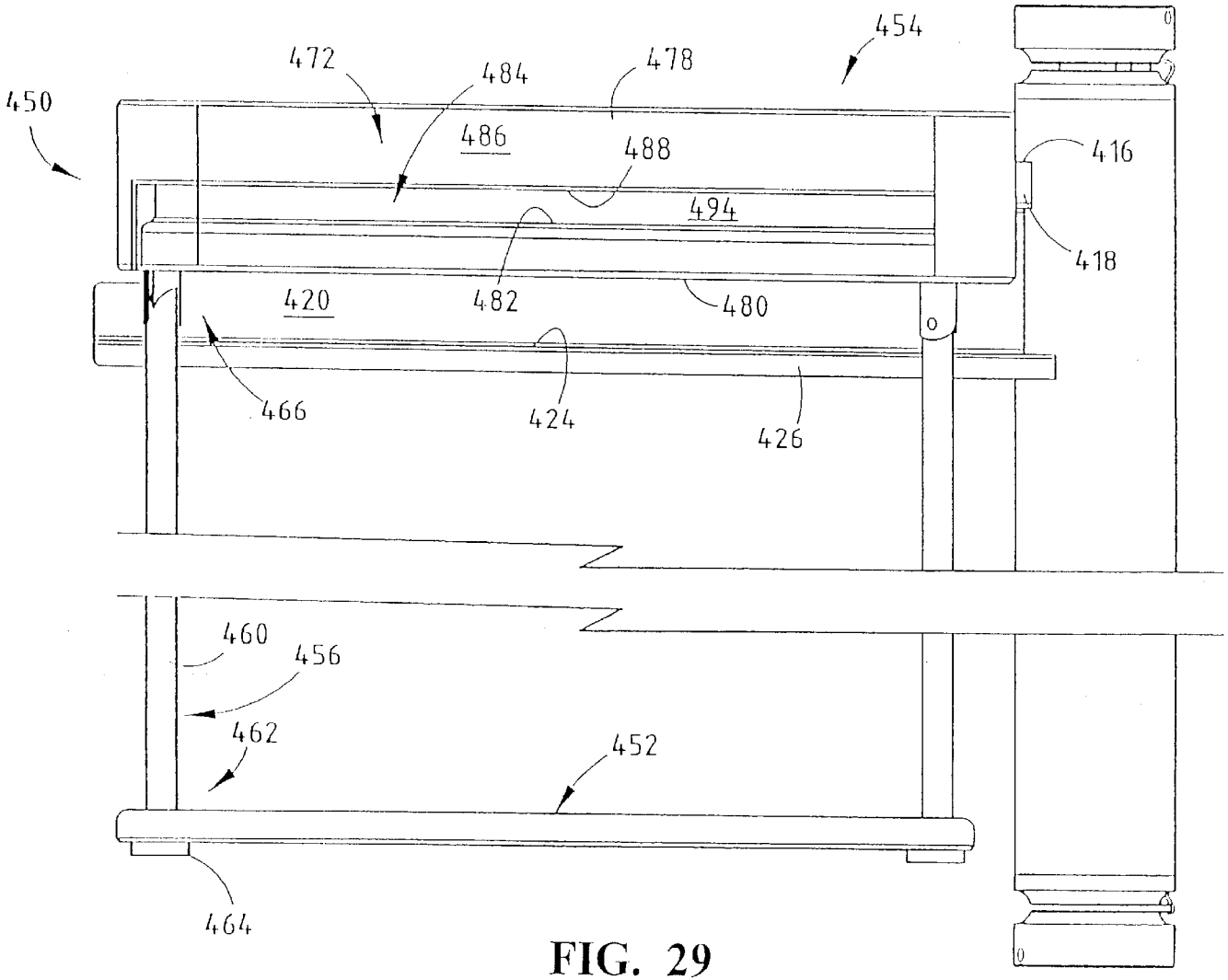
FIG. 29 is a front elevation view of the basket shown in FIG. 28 and mounted on the file support assembly.

Referring to FIGS. 21–24, each file support assembly 228 includes a file support tube 330 having a concentric tubular passage extending entirely therethrough between ends 332 and 334 (See FIG. 24). Disposed axially within support tube 330 is an inner support tube 336, having an axially disposed threaded bolt 338 extending from an end plate 340 recessed within one end 342 of the inner support 336. At the opposite end 344, an end plate 346 is recessed in the inner support tube 336 and supports a sleeve 348 threaded on the interior wall 350. The inner support tube 336 is centered within the file support tube 330 by a pair of file support bushings 356, each received in an opposing end 332, 334 of file support tube 336. An exterior shoulder 352 of each bushing butts against the ends 332, 334 of tube 330 while an inner shoulder or flange 354 butts against the ends 342, 344 of the inner tube 336. Each bushing 356 (FIGS. 25–26) includes a cylindrical sleeve portion 357 having an outside diameter just slightly less than the inside diameter of tube 330, and includes an inside diameter just slightly larger that the outside diameter of tube 336 to provide a snug fit, but not tight enough to prevent rotation of tube 330 about sleeve 356 for reasons which will become apparent below. The peripheral edge of the exterior shoulder 352 is defined by a wall 358 which transitions to a quarter-round annular groove 360 prior to terminating at end 362. Defined concentrically within the end 362 is a cylindrical recess 364 which terminates at the flange 354 described earlier. The inside diameter of the inner shoulder or flange 354 is sufficient to permit bolts 338 or sleeve 348 to extend therethrough and out beyond the end 362. As best shown in FIG. 25, each bushing 350 includes a projection or knob 366 which extends from the outer wall 358 and quarter-round annular groove 360 for purposes of locating the end 362 of each bushing properly within the clevis end 328 of the spreader arms 244, 248, or 252. The knob 366 fits in the gap 368 (FIG. 20) of each clevis 328 to prevent each bushing from rotating relative to each spreader arm or with respect to the file support tubes 330.

Figure 12:
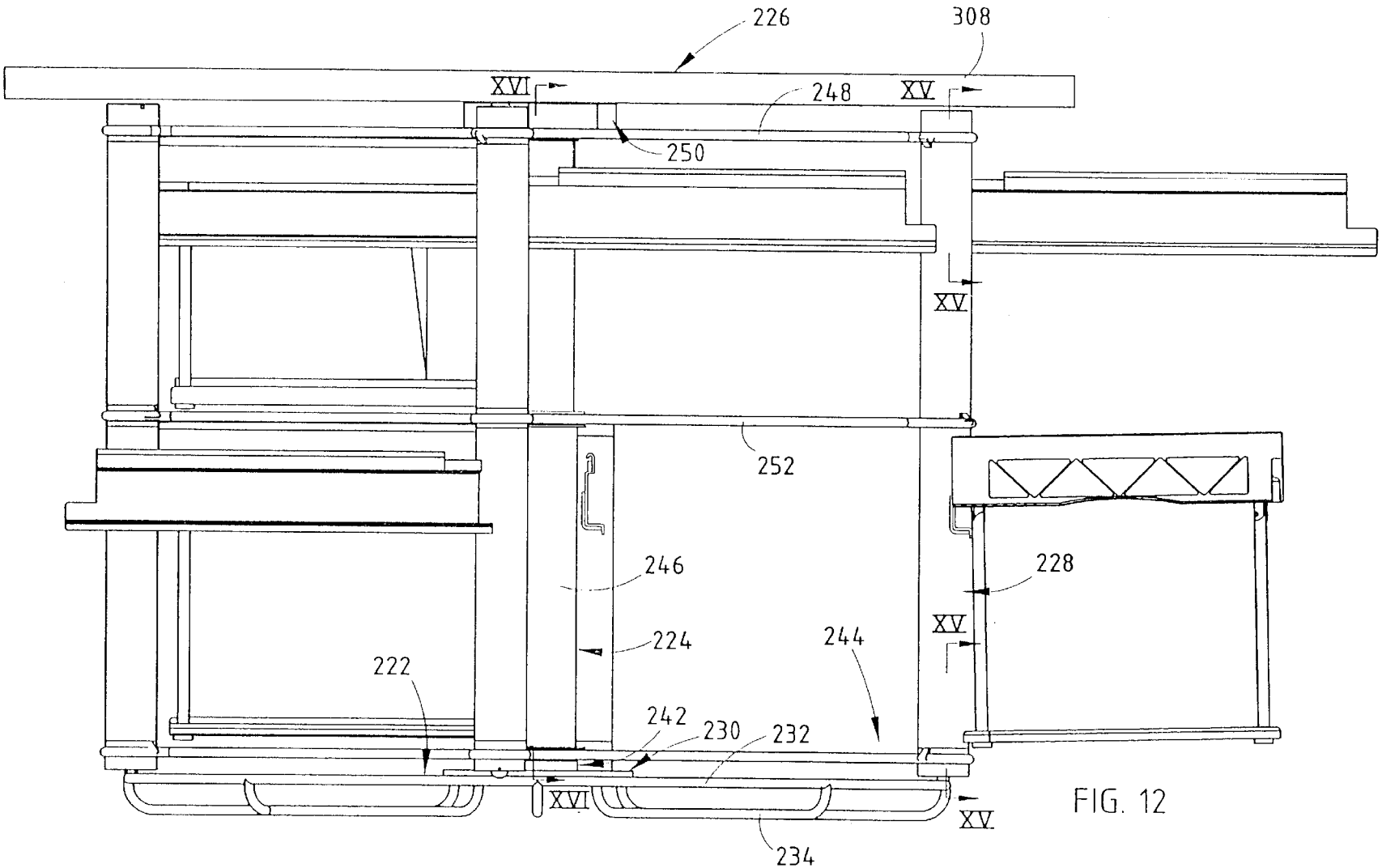
FIG. 12 is an elevation view of an alternate embodiment of the instant invention.
Figure 13:
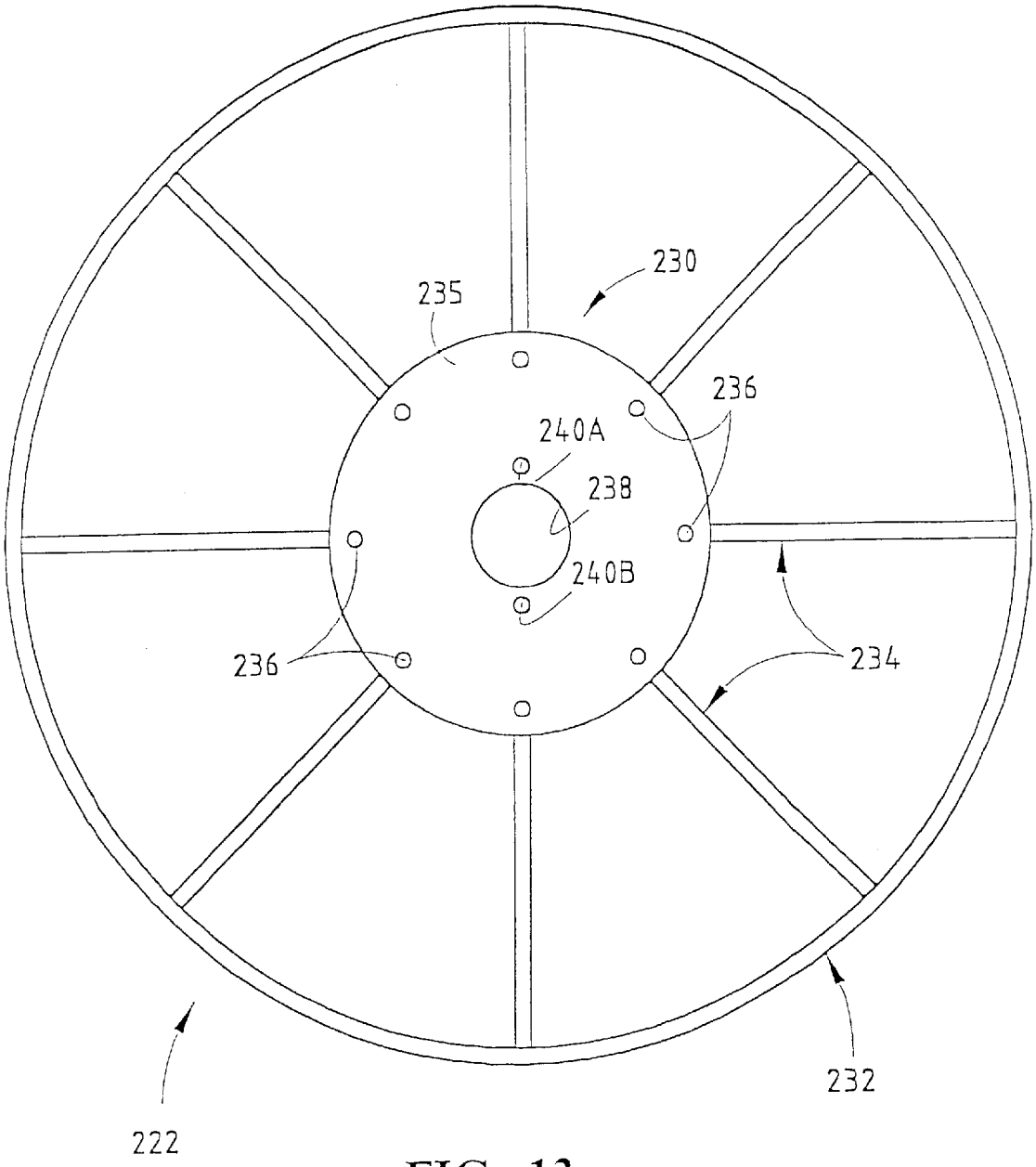
FIG. 13 is a plan view of the base assembly.
Figure 14:
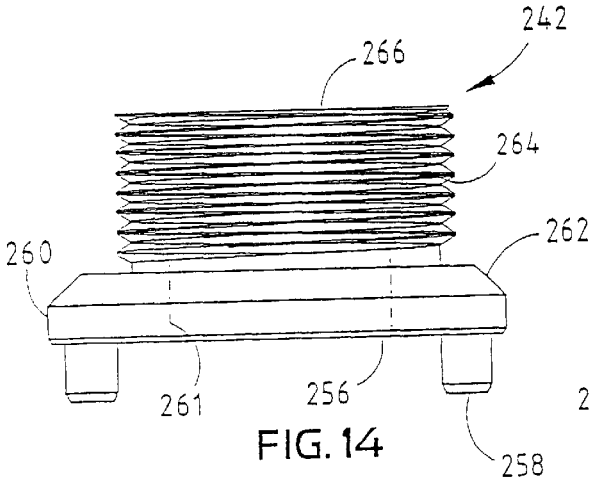
FIG. 14 is an elevation view of a nipple extending from the base assembly.

Referring to FIGS. 12 and 24, each file support assembly 228 is disposed vertically between the clevis ends 328 of the adjacent cross members or spreaders. The quarter-round concentric annular groove 360 in each bushing 356 is dimensioned to receive and nest with the clevis end 328 of each arm 320. In the case of the lower cross member 244, the bushing 356 at the lower end of tube 330 is retained by a bottom wheel support 370 having a first end 372, and an axial threaded passage 374 configured to receive bolts 338. The outer diameter or wall 373 proximate end 372 is dimensioned to be received within a cylindrical recess 364 such that upon tightening of the bottom wheel support 370 along the bolt 338, the end 372 butts against the inner shoulder or flange 354 of the bushing 356, clamping it in place against the end 342 of the inner support tube 336. It is preferred tolerances are such that clamping of the shoulder or flange 354 against the end 342 of the inner tube 336 does not force the outer shoulder 352 against the end 332 of tube 330 to prevent tube 330 from rotating about the bushing 356. However, it is preferred that tolerances are close enough to prevent tube 330 from moving axially along bushing 356. Intermediate the exterior of the bottom wheel support 370, the inner wall 373 transitions outwardly to form a cooperating quarter-round groove 376 which complements quarter-round annular groove 360. Again the dimension of the quarter-round annular groove 376 is such as to be received within and nest against the clevis end 328. Extending inwardly from end 380 is a recess 382 configured to receive and mount a wheel 384 shaped specifically to ride along the outer rim or track 232 of the base assembly 222.

The upper end of the file support assembly 228 shown in FIG. 24 is mounted with a similar wheel support assembly 286 in the event a single tier structure is elected. In addition, the upper wheel support assembly is designed to be used at the uppermost tier of a series of stacked file support assemblies 228. The upper wheel support assembly 386 includes an upper end 388 which contains a recess 390 adapted to partially receive and mount a wheel (not shown) having a more conventional shape and configured to run on the under side of the work surface 308. A quarter-round annular groove 394 is defined in an exterior wall intermediate ends 388 and 396 and configured to nest with the clevis end 328 described above. An annular right circular cylindrical wall 398 defines end 396 and is inset from the quarter-round annular groove 394 and dimensioned to be received in the cylindrical recess 364 in the end of the bushing 356. Concentric within the right circular cylinder annular wall 398 is a threaded bolt 400 adapted to thread with the cylindrical sleeve 348. The end 296 of the circular wall 398 is dimensioned to butt up against the shoulder of flange 354 and urge it against the end 344 of the inner tube 336. In instances where two or more files support assemblies 228 are interconnected in a multi-tier arrangement, the upper wheel support 386 is removed, and the upper file support assembly 228 is held in place by a bolt similar to 338 extending from the lower bushing of the upper file support such as shown in the lower portion of FIG. 24. The bolt is received in the threaded sleeve 348.

Figure 21:
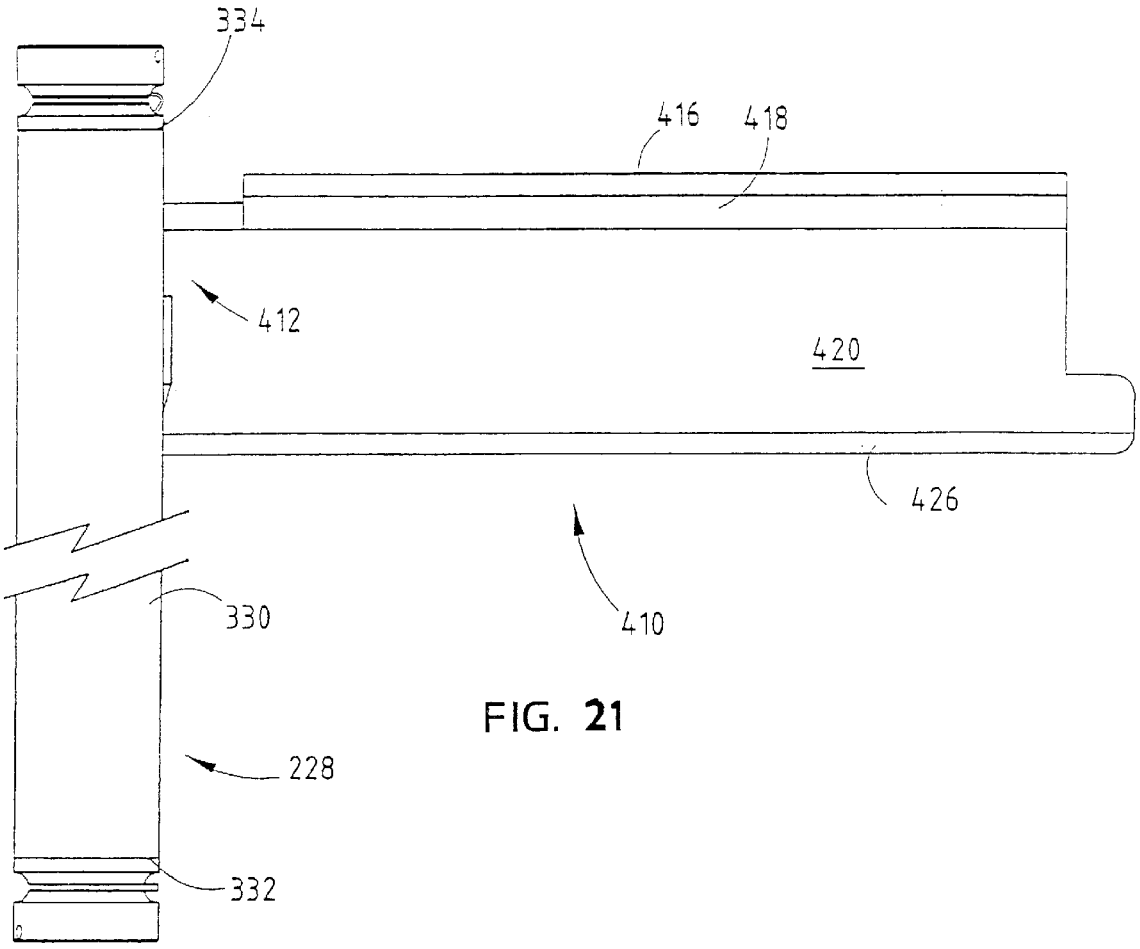
FIG. 21 is a front elevation view of a file support assembly.
Figure 22:
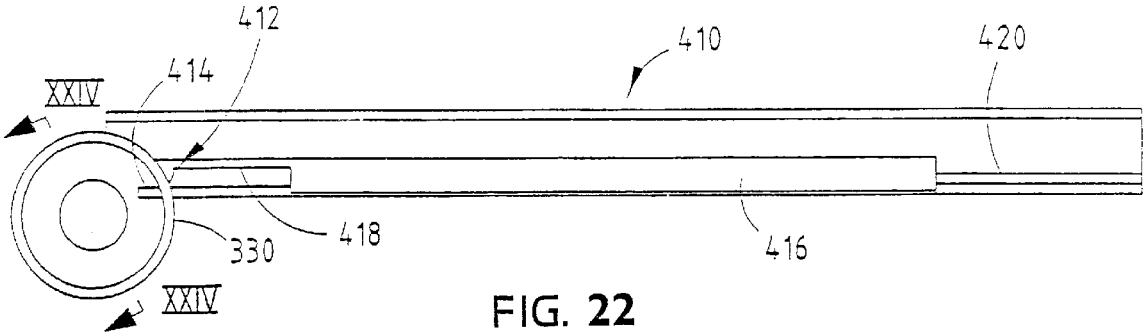
FIG. 22 is a top plan view of the file support assembly shown in FIG. 21.
Figure 23:
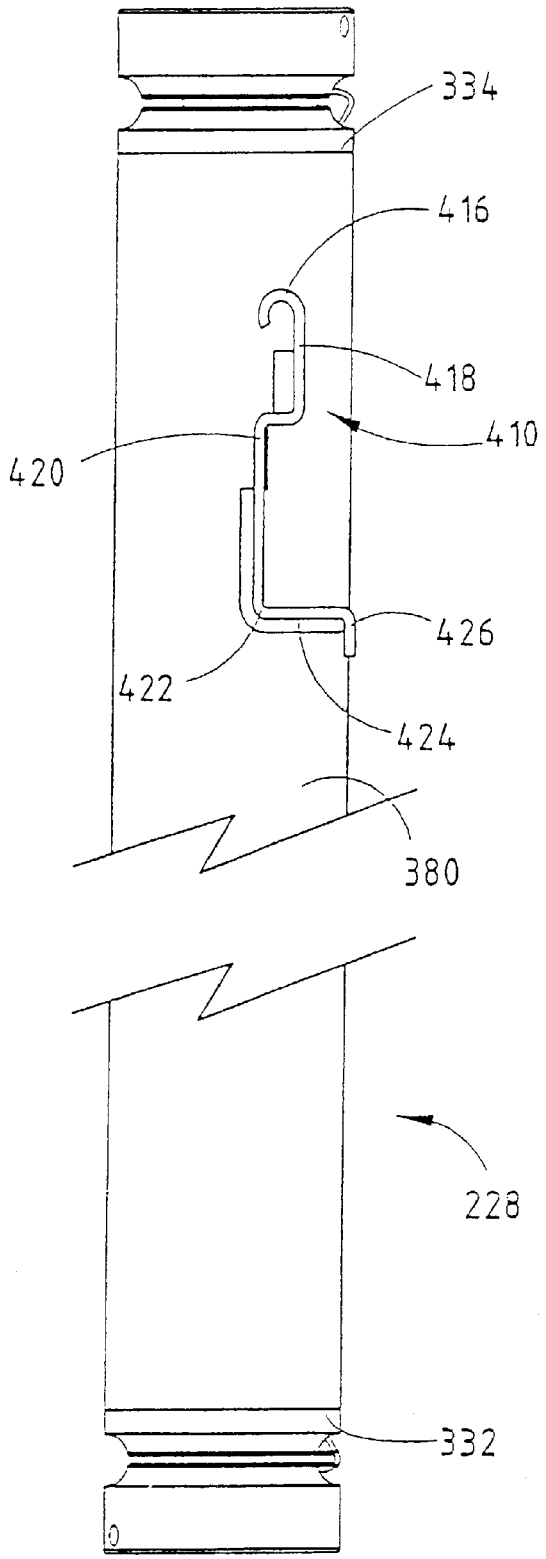
FIG. 23 is a fragmentary side elevation view of file support assembly 228 shown in FIG. 21.

Referring to FIGS. 12 and 21–23, cantilevered from each of the file support tubes 330 is a hanger arm 410. One end 412 of the hanger arm is welded to tube 330 proximate upper end 334 and includes a flange 414 (FIG. 22) which extends through tube 330 and partially into the tubular interior for reasons which will be described below. The hanger arm 410 extending from arm 330 does not extend radially therefrom, but rather is oriented substantially tangentially to the curved surface forming the exterior of the tube 330. As seen best in FIG. 23, the hanger arm 410 includes a generally inverted U-shaped upper edge 416 wherein one leg 418 of the U continues downwardly a predetermined distance before jogging at a substantially right angle to the left to form a greater downwardly depending wall 420. Proximate a lower end of wall 420, the hanger is offset to the right to produce a generally horizontal portion 424 which terminates in a vertical portion 426 which extends to the right beyond the profile of the tube 330. The flange portion 414 (FIG. 22) extending partially into tube 330 extends from wall 418. The lower portion of lower wall 420, bend 422, and lower flange 426 are welded to the exterior of the tube 330 while at the same time the flange 424 terminus 426 wraps around a portion of the circumference of tube 330 to provide rigidity and support to the arm 410. The upper inverted U-shaped portion of edge 416 is configured to be received in a slot in the exterior edge of a basket described below and as a result, may have a predetermined length as shown in FIG. 21. The horizontal flange 424 and the terminus 426 may have a greater dimension than that of the upper edge 416 for the purposes of supporting the lower portion of the basket which depends on the upper edge 416 and to keep the file substantially vertical. The offset between the upper wall 418 and the terminus 426 is defined in substantial part by the relief of the side of the basket between the hanging point, and the legs or sidewalls of the basket.

Figure 26:
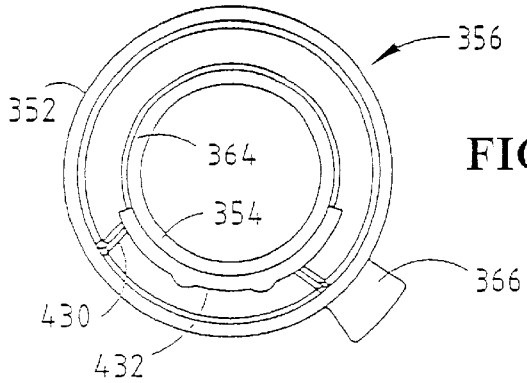
FIG. 26 is a top plan view of the file tube bushing shown in FIG. 25.

The rotation or arc of the hanger arm 410 about the axis defined by the upper and lower bushings 356 is determined in substantial part by the arc defining slot 430 formed in the bushing sleeve 357. With the bushing 356 inserted in the upper portion of the file support tube 330, the flange 414 extends through the file support tube 330 into the slot 430. Since the bushing 356 remains stationary as a result of the knob 366 in the gap the clevis, the flange 414 and the file support tube 330 pivot about the bushing 356. Refer to FIGS. 25 and 26. A spring 432 (shown in FIG. 27) is provided to be retained within the slot 430 and interact with the end of flange 414 to prevent the tube and hanger arm 410 from swinging freely once the file support assembly has been rotated outward. In order to achieve this, detents 434 and 436, defined by changes in radius of the spring 432, engage the end of the flange 414 and create resistance or friction on the end of the flange 414. The spring constant is sufficiently high such that the flange 414 does not easily ride over the detents 434 and 436 without assistance from the operator. The ends of the spring 438 and 440 are bent at substantially right angles to the curvature of the spring and are intended to be received in recesses formed in the interior of the bushing sleeve 356 to keep the spring within the arc subtended by the slot 430 and to keep the spring from being forced to the interior of the bushing when in use. The relative positions of the detents 434 and 436 along the length of the spring may be changed to provide the desired resistance that the appropriate locations.

Another form of the container 450 contemplated to be used in association with the incident invention is shown in FIGS. 28 through 34. In one form, it is contemplated that container 450 may be a collapsible basket that includes a bottom panel 452 suspended from a rim 454 by a plurality of basket legs 456. Bottom panel 452 is preferably rectangular in plan form and may be formed from a number of different materials although injection molded plastic is the preferred embodiment. At the comers of the bottom panel 452, holes 458 extend through the bottom panel and are adapted to slidably receive one of the basket legs 456. In this form of the invention, each basket leg 456 includes a generally cylindrical body 460 which may be straight, or slightly conical or tapered so that it increases in dimension toward its lower end 462 where it terminates in a "T" or flange 464 having a dimension substantially greater than the holes 458. The opposite end 466 of the body 460 is of a dimension less than that of each hole 458 and is attached to rim 454 in a manner described in greater detail below.

The upper rim 454 of the container 450 is generally rectangular in plan form (FIG. 30) and is preferably formed as a unitary component. The rectangular plan form of the rim 454 permits storage of letter and/or legal size documents. As seen in the drawing Figs, the rim 454 includes two diametrically opposing side walls 470, 472 interconnected to diametrically opposing end walls 474 and 476. The exterior surfaces of the side walls 470, 472 (FIGS. 29–32) create an upper perimeter flange 478 which extends substantially around the entire rim 454. The rim also includes a lower perimeter flange 480 which also extends around substantially the entire portion of the rim 454. Intermediate the upper and lower flanges 478, 480, respectively, is an elongated channel 482 configured to receive the inverted U-shaped upper edge 416 of the hanger arm 410. A complimentary inverted U-shaped depression 484 is formed along the entire upper edge of the channel 482 and is set back from the outer wall 486 by flange 488. The inverted U-shaped depression 484 and the flange 488, together with channel 482 receive the upper edge 416 of the hanger arm 410 to suspend the rim 454, the depending basket legs 456, and bottom panel 452 on the hangar arm 410. The length of the channel 482 closely corresponds to the length of the inverted U-shaped upper edge 416 and wall 418 to prevent the basket from sliding along the arm 410. A similar channel structure is defined along the opposite side wall 470 so that either side of the basket or container 450 may be hung from the hangar arm 410.

Figure 30:
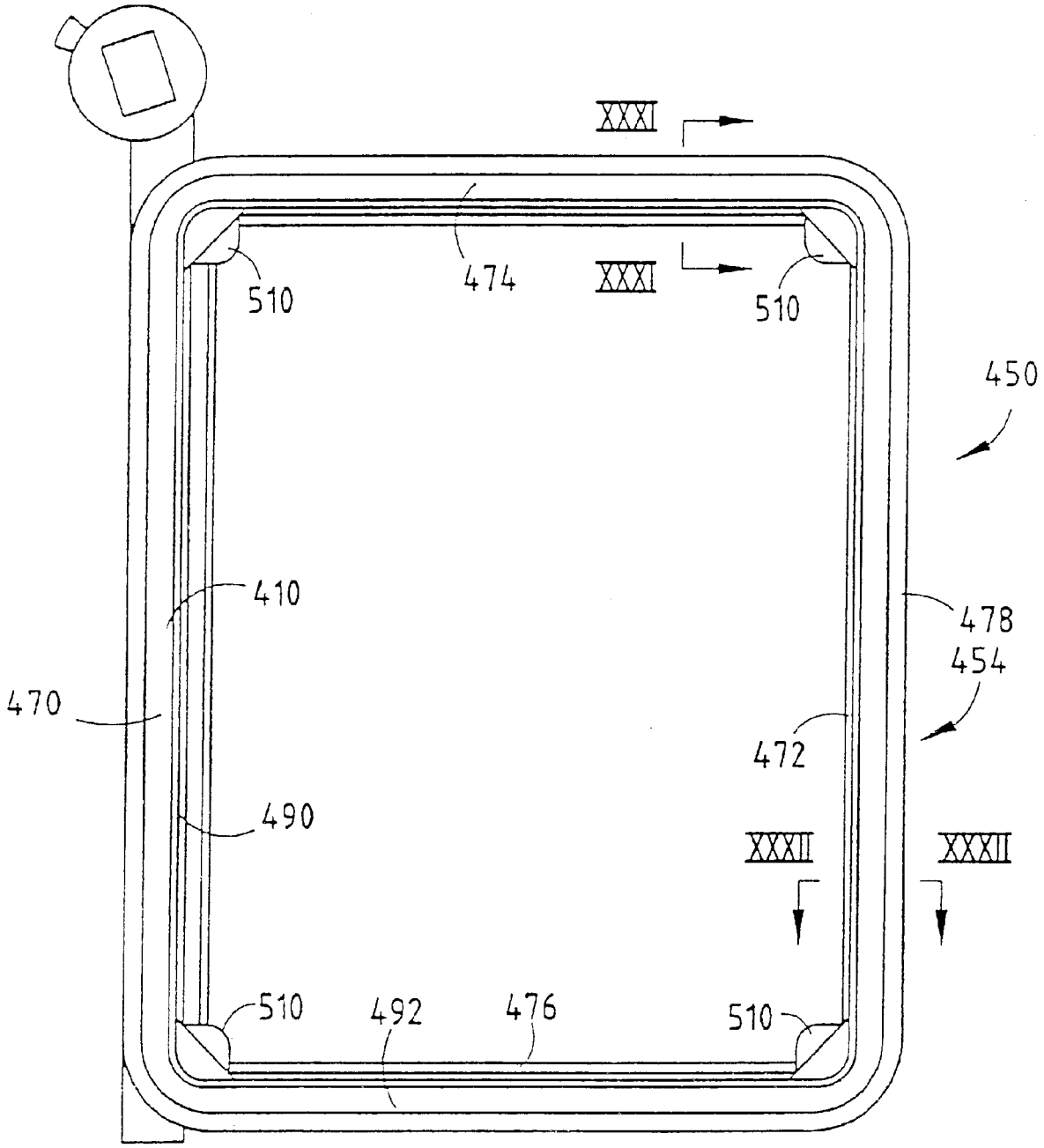
FIG. 30 is a plan view of the file support assembly and basket shown in FIG. 28.
Figure 31:
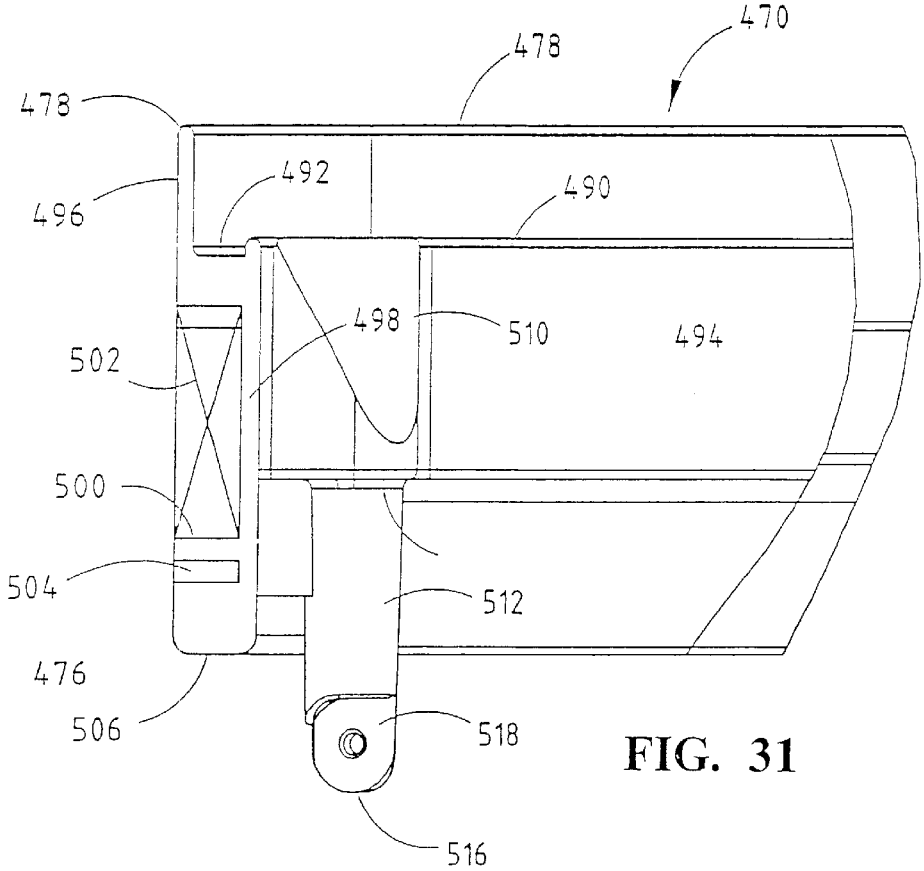
FIG. 31 is a fragmentary section view of the basket shown in FIG. 30 and taken along line XXXI—XXXI.
Figure 32:
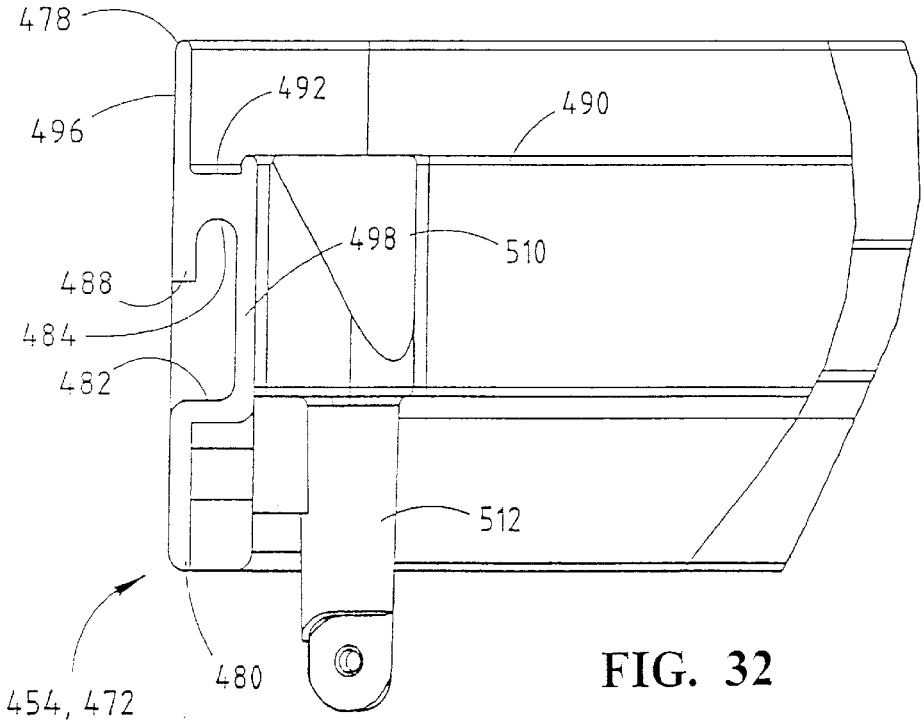
FIG. 32 is a fragmentary section view of the basket sown in FIG. 30 and taken along line XXIX—XXIX.

Defined on the interior of the basket rim 454 is an inner perimeter flange 490 which is separated from the upper perimeter flange 478 by a channel 492. With respect to the side walls 470, 472, the upper perimeter flange 490 is substantially above the wall 494 forming the innermost vertical wall of the channel 482. The inner perimeter flange 490 and channel 492 are intended to provide a structure for hanging file folders such as those available from PENDAFLEX™ or similar hanging files. The perimeter flange 490 and channel 492 extend substantially around the side walls 470, 472 as well as the end walls 474, 476 as best illustrated in FIGS. 30–32. The end walls 474 and 476 also include relief to provide structural rigidity as did channel 482 in the side walls 470 and 472. With respect to end wall 476 shown in FIG. 31, each end wall includes the upper perimeter flange 478 extending upwardly from channel 492 which separates inner perimeter flange 490 therefrom. Below channel 492 and defined in the outside wall 496 is an inset 498 to lie substantially below the inner perimeter rim 490. The channel or depression 500 formed by the offset is braced by a plurality of webs or bulkheads 502. The webbing 502 tends to strengthen the wall while channel 500 reduces the overall waste of material required to form the end walls 474 and 476. Additional relief or contouring of the wall such as shown by slot 504 may be provided to strengthen the end walls 474 and 476. To accommodate the user's hands and provide a gripping location for the rim 454, the lower edge 506 includes an arcuate hand grip 508.

Figure 33:
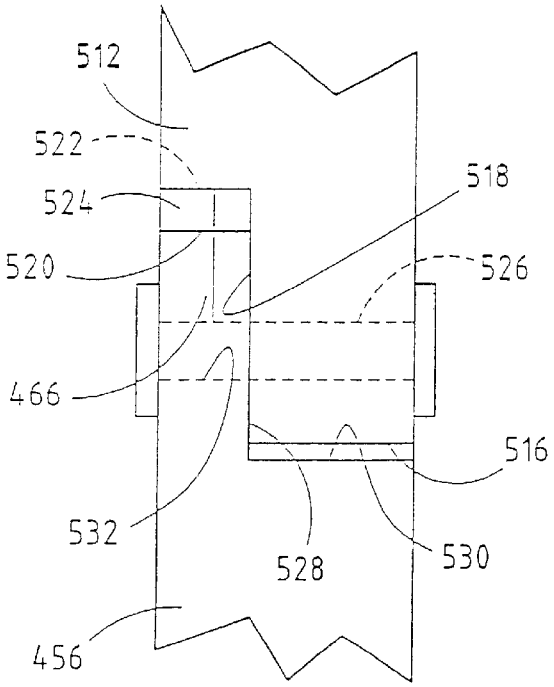
FIG. 33 is a fragmentary elevation view of a connection between a leg and the basket rim.
Figure 34:
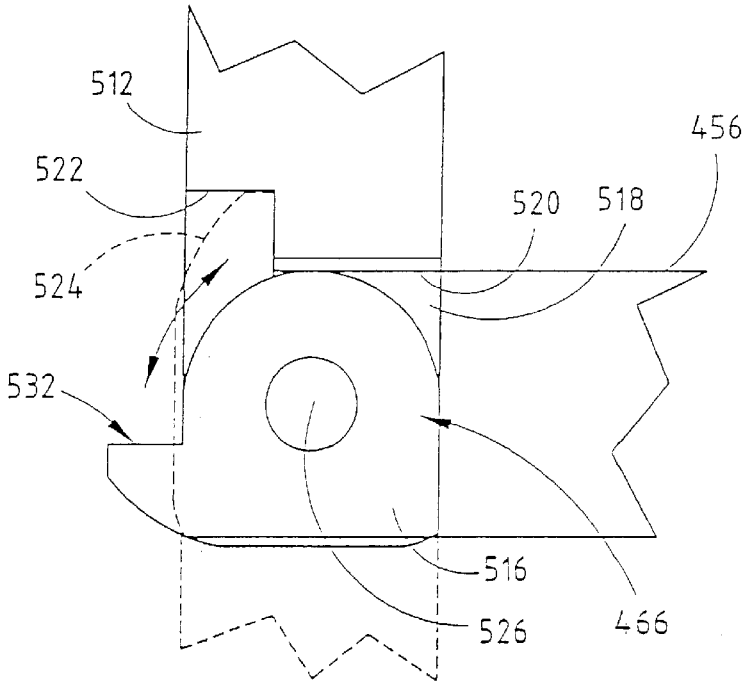
FIG. 34 is a fragmentary elevation view of the connection between the leg and the basket rim at a right angle to the view shown in FIG. 31.

Defined in the interior corners of the rim 454, and extending inwardly from the junctures of the side walls 470, 472 with ends walls 474, 476 are truncated prism-shaped footings or pylons 510. Each footing or pylon 510 includes a downwardly depending column 512 extending from an underside 514. The lower end 516 of each column is adapted to be pivotally coupled to the upper end 466 of a respective basket leg 456 mentioned earlier. Referring to FIGS. 33 and 34, the lower end 516 of the column 512 has a vertical cut face 518 formed along the diameter of the column 512. The cut face 518 terminates in first and second shoulders 520 and 522 offset by a vertical face 524. Extending transversely through cut face 518 may be a horizontally disposed hole 526. The upper end 466 of each basket leg 456 is also split diametrically to form a vertical face 528 which is configured to butt against vertical cut face 518 and with a shoulder 530 to lie adjacent end 516. The upper end 466 also includes a face 532 configured to butt against face 524 when the leg 456 is oriented in the downwardly extending position. End 466 may also contain a transversely extending hole 532 configured to receive a pin (not shown) which extends through hole 532 as well as hole 526 to pivotally couple the leg 456 to the column 512. Alternatively, an integral pin may be formed in either column 512, or leg 456 which extends into a hole formed in the complementing component. The pivotal coupling of the legs 456 to the columns 512 permit the legs to be folded inwardly toward the interior of the basket rim 454 once the bottom panel 452 is raised vertically and nested against the bottom of the rim. If is preferred that column 512 be of sufficient length to receive the bottom panel 452 and extend slightly past to permit the ends 516 to extend below the nested bottom panel 452. To permit the complete folding four legs 456 minwardlytoward the interior of rim 454, the angular orientation of the vertical cut face 518 are different so as to ensure that the legs 456 do not interfere with each other when folded inwardly. One particular embodiment of the angular offset is described in the first embodiment shown in FIGS. 1–12. The nesting of the bottom panel 452 within the rim 454 and the folding of basket legs 456 permits much more consolidated packaging for containers 450, thus reducing cost and less space for shipping.

In both of the embodiments described above, multiple tier structures may be provided and interconnected such that a rotation of one tier results in rotation of the adjacent tiers. In order to make each tier rotate about the central support assembly independently of the other tiers, each tier may be supported by two cross members and braced to prevent racking and excessive bending moments at the termini or clevis end of the arms. In the alternative, multiple single tier units may be stacked one upon another in which the weight of the baskets in each tier is supported by its own base member. Alternatively, a fixed track attached to the central support assembly may be disposed between adjacent tiers wherein wheel supports at the upper and lower file support assemblies run along the track to provide support In yet another embodiment of the invention, each tier could be independently rotated about the central support assembly by providing a substantially rigid planar platform coupled to a perpendicularly extending bearing tube which slips over the central support assembly and permits rotation of the planar support Solid bulkheads or braces may be provided to interconnect the planar member and the file support tube to the bearing tube to support the outer margins of the planar member. The bulkheads would tend to prevent sagging produced by bending moments at the outer extremes of the planar member when the file containers are loaded.

Figure 35:
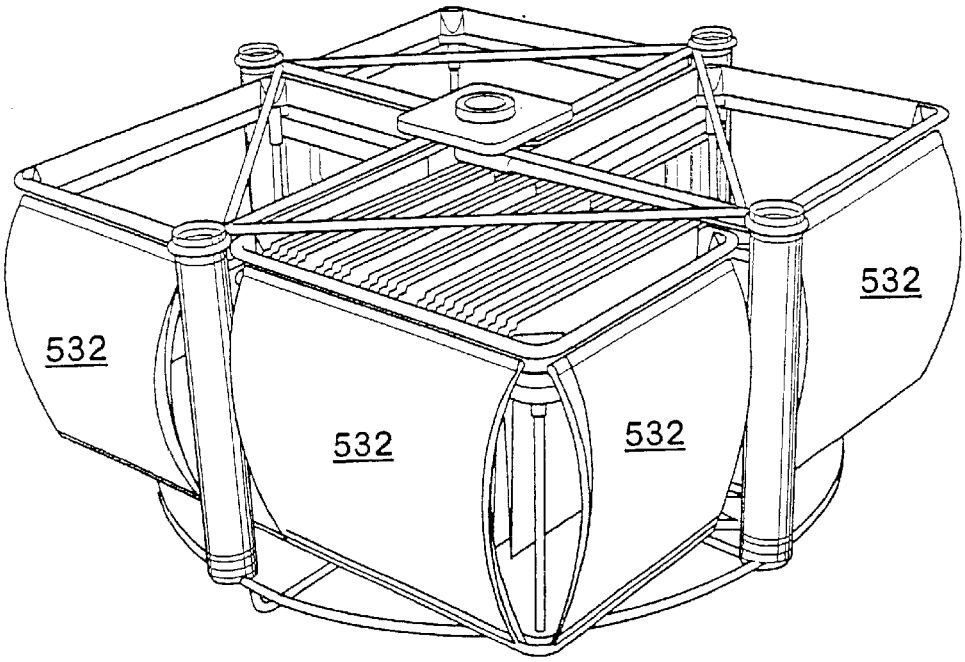
FIG. 35 and 36 illustrate two examples of file container covers.
Figure 36:
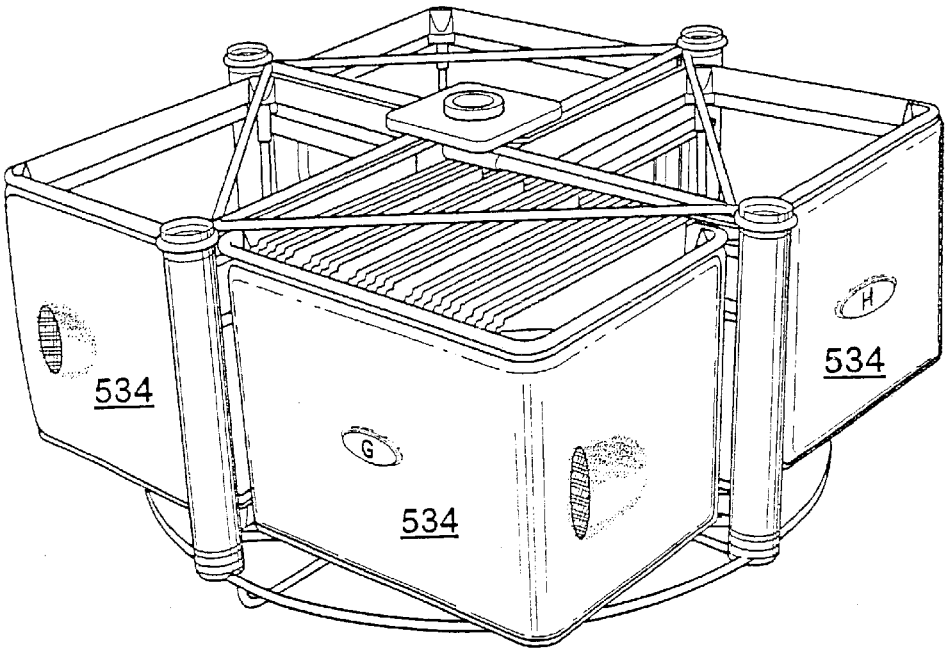

It is contemplated that in a basic form of the invention, the carousel filing cabinet will not be enclosed, but rather accessible from all sides of the file cabinet It is further contemplated a more aesthetic and pleasing appearance may be achieved by providing a cover 532 for each container to conceal the contents. Such covers 532 could include drapes, wraps, shrouds, hard sides, or other concealing mechanisms which extend downwardly below the rim to the lower platform. For example, flexible sheeting 534 may be detachably connected to the lower perimeter flange of rim 454 and shaped to extend around the basket legs 456 to form a wall or barrier between the rim 454 and a lower platform 452. This flexible sheeting may be of substantially any color and serve to restrict access to the contents of the containers 450. The flexible sheeting may be formed from cloth, polymeric material, bent wood, perforated metal, or conventional metal sheeting. See FIGS. 35 and 36. Rather than depending from lower perimeter flange 480, covering may also be formed for each of the containers to depend from the inner perimeter flange 490 which also serves to suspend the hanging files. Alternatively, clips may be fixed to the sheeting material and attached to the interior of the rim to keep the cover in place.

One of the conceptual philosophies behind the rotary file cabinet was to provide a portable filing container which may be detached from the file cabinet assembly and transported to the work station, or to the user's place of business (vehicle, home, etc.). To achieve this goal, the containers 450 are not necessarily restricted to conventional dimensions of letter and legal size openings. For example, in the case of a letter size container, one dimension may be sufficient to accept the length of conventional writing papers, say 11½ to 12 inches while the width of the container may be substantially less, on the order of approximately 6 to 10 inches. Detachable handles may be configured which permit the user to carry the container 450 in a manner similar to a conventional briefcase or catalog case. Such a handle may similarly be made from a canvas material, leather, or metallic material of sufficient strength to support the weight and stresses associated with the handle. Additionally, given the desire to have portable containers, the covering depending from the rim 454 may have interior or exterior pockets for storing accessories such as pens and pencils, cellular telephones, envelopes, staplers, and the like. The pockets could be sewn to the cloth exterior, or could be detachably coupled using hook and loop fasteners such as those available under the brand name VELCRO™. Once back in the office, the user could then detach the cloth covering and reattach it to another file that may be taken from the file cabinet assembly.

It may also be desirable to enclose the rotary file cabinet. In such an instance, it is contemplated that a curtain or other enclosure would depend from the top of work surface 308. For example, metal sheeting maybe attached to the underside of top 308 by a track such that the sheets may fully encircle the filing cabinet assembly when in the closed position, The segments may slide open to expose 90°,180°, or 270° of the available filing space. Alternatively, rather than a metallic sliding door, a tough and durable fabric curtain may be drawn around the entire filing cabinet assembly to conceal the files.

The advantages provided by this invention include providing a file cabinet which is not subject to tipping over when one or more file drawers are in the open position. This is achieved by counterbalancing open files by files on the opposite side of the central support. A further advantage is that the circular rotation of the filing cabinet permits access to otherwise inaccessible space in certain office environments. Another advantage provided by this system is that two or more units may be stacked vertically upon each other to achieve the necessary storage space. Yet another advantage is that the entire filing cabinet may be shipped in a disassembled state and assembled by the end user without the need for special tools. Thus, the entire assembly may be shipped in a smaller container than conventional filing cabinets, reducing the cost of shipment and providing a less expensive product.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention as interpreted according to the principles of patent law, including the doctrine of equivalents.

We claim:

1. A carousel file cabinet, comprising in combination;

a base;

a primary support extending substantially perpendicular from said base;

a top assembly supported by an opposite end of said primary support a plurality of file supports spaced around said primary support each rotatable between a stowed position beneath said top assembly, and an extended position out from under said top assembly about a axis substantially parallel to said primary support;

a plurality of spiders rotatably coupled at one end to said primary support and having an opposite end rotatably coupled to a respective one of said plurality of file supports; and a file container detachably suspended from each of said plurality of file supports.

2. The carousel file cabinet as defined in claim 1, further comprising a plurality of tiers of said plurality of file supports, stacked upon one another by said plurality of spiders rotatably coupled about said primary support assembly.

3. The carousel file cabinet as defined in claim 1, wherein said base includes a hub, a plurality of spokes, each having one end attached to said hub and an opposite end radiating outwardly from said hub, and a rim interconnecting said opposite end of said plurality of spokes, said rim defing a track disposed substantially beneath the plurality of file supports.

4. The carousel file cabinet as defined in claim 3, wherein said primary support includes:

at least one tubular member having a first end attached to said base, and a second end attached to said top assembly, and a plurality of bushings interconnecting said tubular member to said base and said top assembly, each of said plurality of bushings configured to support one of said plurality of spiders and permit each of said plurality of spiders to rotate about an axis defined by said tubular member.

5. The carousel file cabinet as defined in claim 4, wherein each of said plurality of file supports includes:

a cylindrical file support member having first and second ends;

a bearing member disposed in each of said first end and second ends, each bearing member attached to one of said pluraity of spiders;

a hanger arm extending from said cylindrical file support member at a point proximate said first end; and a detent member internal said cylindrical file support member and cooperating with an end of said hanger arm to restrict said hanger arm and said cylindrical support member from rotating freely about said axis between said stowed position and said extended position.

6. The carousel file cabinet as defined in claim 5, wherein said file container includes:

a basket rim formed from a plurality of contoured walls;

a plurality of legs pivotally coupled to said basket rim and movable between an extended position and a position ret ed toward an interior of said basket rim; and a bottom panel slidably received along said plurality of legs and configured to nest against a lower edge of said basket rim.

7. The carousel file cabinet as defined in claim 6, further comprising a plurality of tiers of said plurality of file supports, stacked upon one another by said plurality of spiders rotatably coupled about said primary support assembly.

8. The carousel file cabinet as defined in claim 1, wherein said primary support includes:

at least one tubular member having a first end attached to said base, and a second end attached to sad top assembly; and a plurality of bushings interconnect said tubular member to said base and said top assembly, each of said plurality of bushings configured to support one of said plurality of spiders and permit each of said plurality of spiders to rotate about an axis defined by said tubular member.

9. The carousel file cabinet as defined in claim 1, wherein each of said plurality of file supports includes:

a cylindrical file support member having first and second ends;

a bearing member disposed in each of said first end and second ends, each bearing member attached to one of said plurality of spiders;

a hanger arm extending from said cyndrical file support member at a point proximate said first end; and a detent member internal said cylindrical file support member and cooperating with an end of said hanger arm to restrict said hanger arm and said cylindrical support member from rotating freely about said axis between said stowed position and said extended position.

10. The carousel file cabinet as defined in claim 1, wherein said file container includes:

a basket rim formed from a plurality of contoured walls;

a plurality of legs pivotally coupled to said basket rim and movable between an extended position and a position retracted toward an interior of said basket rim; and a bottom panel sidably received along said plurality of legs and configured to nest against a lower edge of said basket rim.

11. A file cabinet configurable between one and a plurality of tiers, comprising in combination:

a base having a central hub, a plurality of radially extending spokes, and an outer rim interconnecting said plurality of spokes.

a central support column connected at one end to said central hub, and having an opposite end extending tom said base;

a top assembly coupled to, and supported by, said opposite end of said central support;

a plurality of file supports disposed around said central support column, each file support having a file support member, a bushing disposed in opposite ends of said file member, and a hanger arm extend from said file support member;

a plurality of spiders rotatably mounted along said central support column and interconnected to said bushings for providing rotation of said plurality of file supports about said central support colunm, and permitting each of said plural of file supports to rotate about an axis defined between said bushings; and a file container detachably mounted to said hanger arm.

12. The file cabinet as defined in claim 11, wherein said central support column includes at least a first cylinder configured to attach to said central hub at one end and to said top assembly at an opposite end, and adapted to be connected to a second cylinder to add a tier to the cabinet.

13. The file cabinet as defined in claim 11, wherein each of said plurality of file supports includes:

a file support member pivotally coupled to at least one of distal end of said plurality of spiders; and a hanger arm extending from said file support member.

14. The file cabinet as defined in claim 11, wherein said file container includes:

a basket rim;

a plurality of legs depending from said rim; and a bottom panel attached to said plurality of legs.

15. A file cabinet kit, comprising in combination:

a base;

at least one support having one end configured to be attached to said base;

at least one spider rotatably mounted on said at least one primary support, sad spider having a plurality of radiating arms, each having a distal end spaced from said primary support;

a plurality of file supports radially arranged around said at least one primary support, each mounted to said distal end of one of said radiating arms to permit each file support to rotate about a vertical axis between a retracted position and an extended position; and at least one file container adapted to be detachably suspended on each of said plurality of file supports.

16. A file cabinet, comprising in combination:

a base assembly;

a central support assembly extending from said base assembly;

at least one spider rotatably coupled to said central support assembly and having arms extending radially away from said support assembly;

at least one file support assembly having an upper end rotatably coupled to and depending from a distal end of one of said arms of said at least one spider and rotatably between an extended position away from said at least one spider and a closed position proximate said at least one spider;

a container assembly detachably coupled to said at least one file support assembly; and a plurality of tiers of said at least one file support assembly, each of said plurality of tiers independently rotatable about said central support assembly.

17. The file cabinet as defined in claim 16, wherein said base assembly includes:

a hub;

a rim disposed concentrically around said hub; and a plurality of spokes interconnecting said rim to said hub.

18. The file cabinet as defined in claim 17, wherein said rim of said base assembly includes a tack for providing vertical support to said at least one file support assembly.

19. The file cabinet as defined in claim 16, wherein said central support assembly includes:

at least one body;

a member for coupling said body to said base assembly; and at least one bearing assembly disposed along said at least one body for rotatably coupling said at least one arm assembly to said central support assembly.

20. The file cabinet as defined in claim 16, wherein said at least one file support assembly includes:

a file support tube having a first end and a second end;

a hanger arm intermediate said first and second end of said file support tube and extending perpendicular thereto; and at least one bearing assembly in one of said first and second ends of said file support tube and coupled to said at least one arm assembly.

21. The file cabinet as defined in claim 20, wherein said at least one file support assembly includes a wheel support assembly for engaging one of said base assembly and said top assembly.

22. The file cabinet as defined in claim 20, wherein said at least one file support assembly includes a detent mechanism for preventing said file support tube and hanger arm from rotating freely between said extended position and said closed position.

23. The file cabinet as defined in claim 16, wherein said container assembly includes;

a basket rim;

a plurality of legs pivotally coupled to said basket rim and configured to pivot between a first position extending away from said basket rim, and a second position toward an interior of said basket rim; and a bottom panel slidably disposed along said plurality of legs and configured to nest against a lower edge of said basket rim.

24. The file cabinet as defined in claim 23, wherein said container assembly includes:

a plurality of walls interconnected together to form said rim, at least one of said walls having a recess configured to receive a portion of said file support assembly therein and detachably suspend said container assembly.

25. The file cabinet as defined in claim 23, said container assembly includes a cover extending downwardly from said rim to conceal an interior of said container assembly.

26. A file cabinet, comprising in combination:

a base;

a support extending generally perpendicularly from a central portion of said base;

at least one spider attached to said support and having a plurality of arms extending radial away from said support; and a file support mounted to a terminal end of each of said plurality of arms for detachably receiving a container thereon storing articles selected by a user, said file support rotatable about an axis generally parallel to said support.

27. The file cabinet as defined in claim 26, further comprising a top attached to and supported by an upper end of said support.

28. The file cabinet as defined in claim 26, wherein said at least one file support mounted to said terminal end of said at least one arm includes a portion supported by said base.

29. The file cabinet as defined in claim 26, wherein said at least one spider is rotatable about an axis generally parallel to said support.

* * * * *